US007950263B2

(12) United States Patent
Shinguryo

(10) Patent No.: US 7,950,263 B2
(45) Date of Patent: May 31, 2011

(54) CAN BODY MANUFACTURING METHOD, CAN BODY AND CAN BODY MANUFACTURING APPARATUS

(75) Inventor: Takuro Shinguryo, Gotenba (JP)

(73) Assignee: Universal Can Corporation, Tokyo (JP)

( * ) Notice: Subject to any disclaimer, the term of this patent is extended or adjusted under 35 U.S.C. 154(b) by 927 days.

(21) Appl. No.: 11/577,936

(22) PCT Filed: Sep. 20, 2005

(86) PCT No.: PCT/JP2005/017311

§ 371 (c)(1),
(2), (4) Date: Apr. 25, 2007

(87) PCT Pub. No.: WO2006/046371

PCT Pub. Date: May 4, 2006

(65) Prior Publication Data

US 2008/0149648 A1 Jun. 26, 2008

(30) Foreign Application Priority Data

Oct. 26, 2004 (JP) ..... 2004-310774
Dec. 20, 2004 (JP) ..... 2004-367905
Jun. 27, 2005 (JP) ..... 2005-186463

(51) Int. Cl.
*B21D 51/32* (2006.01)

(52) U.S. Cl. ..... 72/715; 72/379.4; 413/1; 413/76

(58) Field of Classification Search ..... 72/94, 105, 72/106, 379.4, 715; 220/667, 672, 673, 674; 413/1, 69, 72–77

See application file for complete search history.

(56) References Cited

U.S. PATENT DOCUMENTS 5,397,021 A * 3/1995 Usui ..... 220/667
5,761,942 A * 6/1998 Johnson et al. ..... 72/94
5,799,525 A * 9/1998 Johnson et al. ..... 72/105

FOREIGN PATENT DOCUMENTS

JP UM-B-02-042353 11/1990
JP 10-328772 A 12/1998

(Continued)

OTHER PUBLICATIONS

International Search Report for PCT/JP2005/017311 mailed Nov. 8, 2005.
Japanese Office Action mailed Aug. 24, 2010 for the corresponding Japanese application No. 2004-310774.

(Continued)

*Primary Examiner* — Jimmy T Nguyen
(74) *Attorney, Agent, or Firm* — Leason Ellis LLP.

(57) ABSTRACT

A can body manufacturing method has a barrel section of the can body held between first and second rotation bodies. The first body has at a first recess in its outer surface, and the second body has a second projection on its outer surface. The bodies are brought together so the barrel section is pressed radially inward by the second projection and fits into the first recess. When the holding of the barrel section by the rotation bodies is released, that portion of the barrel section corresponding to the first recess and the second projection is caused to restore elastically radially outward. As a result, the outer surface of that portion of the barrel corresponding to the projection and recess is caused to position more outside than the rest of the outer surface of the barrel section.

4 Claims, 9 Drawing Sheets

FOREIGN PATENT DOCUMENTS

| | | | |
|---|---|---|---|
| JP | 2000-515072 | A | 11/2000 |
| JP | A-2000-317531 | | 11/2000 |
| JP | A-2001-030033 | | 2/2001 |
| JP | 2003-20038 | A | 1/2003 |
| JP | 2003-260520 | A | 9/2003 |
| JP | A-2004-025273 | | 1/2004 |
| WO | 97/21505 | A1 | 6/1997 |
| WO | 98/03279 | A1 | 1/1998 |
| WO | 98/03280 | A1 | 1/1998 |

OTHER PUBLICATIONS

Japanese Office Action mailed Aug. 24, 2010 for the corresponding Japanese application No. 2004-367905.

Japanese Office Action mailed Aug. 24, 2010 for the corresponding Japanese application No. 2005-186463.

Japanese office action mailed Jan. 4, 2011 for the corresponding Japanese Patent Application No. 2004-367905.

* cited by examiner

CAN BODY MANUFACTURING METHOD, CAN BODY AND CAN BODY MANUFACTURING APPARATUS

TECHNICAL FIELD

The present invention relates to a can body manufacturing method in which a can body is manufactured by performing embossing processing on a drum portion of a can base that has been formed as a hollow cylinder having single closed end, and to a can body, and a can body manufacturing apparatus.

Priority is claimed on Japanese Patent Application No. 2004-310774, filed Oct. 26, 2004, Japanese Patent Application No. 2004-367905, filed Dec. 20, 2004, and Japanese Patent Application No. 2005-186463, filed Jun. 27, 2005, the contents of which are incorporated herein by reference.

BACKGROUND ART OF THE INVENTION

As is widely known, in what are known as cans and bottle cans that are filled with refreshment drinks and the like, in order to arouse the desire of a consumer to purchase such drinks, a variety of designs and the like are affixed to the drum portion so that a product identification capability and the like is given to these cans. Conventionally, for example, providing coatings or embossing processing are known as ways of providing such designs.

As far as the latter, i.e., embossing processing, is concerned, a method such as that shown in, for example, Patent Document 1 noted below is known for forming a can body by performing embossing processing on the drum portion of the can base. In this method, there are provided a first rotating body and a second rotating body that are supported so as to be able to rotate around rotation axes that are parallel with each other. The first rotating body is placed on an interior side of a single close-ended cylindrical can base, and the second rotating body is placed on an outer side of the can base. Next, the first and second rotating bodies are moved towards each other and, in a state in which the drum portion of the can base is sandwiched between the outer circumferential surfaces of the respective rotating bodies, the first and second rotating bodies are rotated around their rotation axes.

Note that a DI can that is formed by performing, for example, twisting and ironing processing on a metal plate is used as this can base. Moreover, because this method also has the function of guiding the can base in the radial direction (referred to below as a 'guiding function') by making the outer circumferential surface thereof conform to the inner circumferential surface of the can base when the first rotating body is inserted into the interior side of the can base, there is only a small difference between the inner diameter of the can base and the outer diameter of the first rotating body which is typically kept to approximately 0.8 mm.

In recent years, in order to impart an even greater product identification capability to cans and the like, there have been demands for convex embossing processing that protrudes outwards in the radial direction from the outer circumferential surface of the drum portion of a can base.

However, in the conventional can body manufacturing method, in addition to the fact that there is only a small gap between the outer circumferential surface of the first rotating body and the inner circumferential surface of the can base, because it is necessary to form a first convex portion that protrudes outwards in the radial direction from the outer circumferential surface of the first rotating body in order to provide the convex embossing processing on the can drum portion (referred to below as the 'embossing processed portion'), the aforementioned gap becomes even smaller by the same distance as the height of the protrusion of the convex portion.

Accordingly, when this first rotating body is inserted into the interior side of the can base, there is a possibility that the first convex portion of this rotating body will collide with an aperture end portion of the can base. In addition, after the embossing processed portion has been formed, when the first rotating body is being withdrawn from the interior side of the can base, there is a possibility that the convex portion of the rotating body will become caught on the inner circumferential surface of the embossing processed portion. The problem has accordingly arisen that it is difficult to form this type of embossing processed portion. Furthermore, because the first convex portion which is the outermost portion in the radial direction of the first rotating body functions as a guide portion that guides the inner circumferential surface of the can base, when only a small proportion of the entire outer circumferential surface of the first rotating body is occupied by the first convex portion, it is not possible to sufficiently demonstrate the aforementioned guiding function.

In order to solve the above described problems, the following method may be considered. Namely, a first concave portion that is recessed inwardly in the radial direction is formed in the outer circumferential surface of the first rotating body, and the first convex portion is formed on a bottom surface of this concave portion. In addition, a second convex portion that protrudes outwardly in the radial direction is formed on a portion of the outer circumferential surface of the second rotating body that corresponds to the first concave portion, and a second concave portion that is recessed inwardly in the radial direction is formed in a portion of this second convex portion that corresponds to the first convex portion. When a can drum portion is then sandwiched between these rotating bodies, the portion of the can body that corresponds to the first concave portion and the second convex portion is depressed inwardly in the radial direction so as to form a concave processed portion, and the embossing processed portion is formed in portions corresponding to the first convex portion and the second concave portion.

However, in this method, as a result of both convex and concave embossing processed portions being formed in the can drum portion, there is an increase in the proportion of the overall can drum portion that is occupied by plastically deformed portions. As a result, the problems arise that there is a lowering of the obtainable buckling strength of the can body, breakages occur in the coating film formed on the inner and outer surfaces of the can drum portion, and what is known as blocking may occur when a plurality of can bodies are transported collectively on a transporting conveyor. Furthermore, the problem has also arisen that it has not been possible to reliably prevent the aforementioned first rotating body from becoming caught as is described above when it is extracted from a can body.

Note that, because the above described embossing processing is performed after the coating film has been formed on the inner and outer surfaces of the can base, the coating film is easily damaged during this embossing processing by the convex portions or concave portions or by the convex portions and concave portions that are formed on the outer circumferential surfaces of each of the rotating bodies.

In order to prevent this type of damage to the coating film, for example, as shown in FIG. 9, the size of a convex portion 101*a* that is formed on the outer circumferential surface of a first rotating body 101 is made smaller than the size of a concave portion 102*a* that is formed on an outer circumferential surface of a second rotating body 102.

Accordingly, when the drum portion of a can base is sandwiched between outer circumferential surfaces of the rotating bodies 101 and 102, the can drum portion that is positioned between the upright surfaces 101*b* and 101*b* of the wall surface forming the convex portion 101*a* that extend outwardly in the radial direction from the outer circumferential surface of the first rotating body 101, and the inner wall surfaces 102*b* and 102*b* of the wall surface forming the concave portion 102*a* that are opposite the upright surfaces 101*b* and 101*b* and extend inwardly in the radial direction from the outer circumferential wall of the second rotating body 102 is stretched in the radial direction in what might be called an unrestrained state.

As a result, when the can drum portion is sandwiched between outer circumferential surfaces of the first and second rotating bodies 101 and 102, the problem arises that abrasion tends to occur easily between surfaces 101*c* of the first rotating body 101 that are outermost in the radial direction and the upright surfaces 101*b*.

Moreover, while the can drum portion is being sandwiched, because it is stretched in an unrestrained state, the unrestrained portion is pulled gently upright in the radial direction from the circumferential surface of the can drum portion and the problem arises that it is difficult to form a well-defined embossing processed portion.

However, in recent years, in order to impart an even greater product identification capability to cans and the like, there have been demands for well-defined embossing processed portions having sharp upright portions in the drum portion of a can base, and there have also been demands for a plurality of embossing processed portions to be formed in a tight grouping in a small area.

However, as is described above, as it is difficult to form this type of embossing processed portions, then if an attempt is made to form even more well-defined embossing processed portions, it is necessary to increase the height of the convex portions 101*a* and the depth of the concave portions 102*a* and narrow the width of the convex portions 101*a*, and to further increase the amount of embossing processing on the outer surface of the drum portion of the can base. In this case, there is a possibility that the convex portions will be bent easily and that tension will cause the coating film formed on the inner and outer circumferential surfaces of the drum portion of the can base to become damaged. As a result, the problem arises that it is even more difficult to form this type of embossing processed portion.

Moreover, if the amount of embossing processing is increased, then there is a corresponding greater amount of flow in the material of the drum portion of the can base during the embossing processing, and there is also a greater amount of tensile deformation in the can drum portion which is in an unrestrained state. This causes the thickness of the can drum portion which includes these areas to become even thinner. As a result, if an attempt is made to form a plurality of well-defined embossing processed portions, then it is necessary to increase the distance between adjacent embossing processed areas, and the problem arises that it is difficult to carry out what is known as fine processing in which a plurality of embossing processed portions are formed in a tight grouping.

Furthermore, the convex portions 101*a* and the concave portions 102*a* are typically formed using laser processing, however, if the height and depth of the portions 101*a* and 102*a* are increased, there is a corresponding reduction in the processing accuracy. Consequently, the problem has arisen that there is a reduction in the accuracy with which the embossing processed portions are formed.

It should be noted that, there are also demands when carrying out embossing processing on a can drum portion for rectilinear ridgelines to be formed at, for example, approximately 5 or 6 mm intervals, and for a plurality of folded portions having only a small amount of concavity and convexity to be formed adjacent to each other so as to create a fine pattern. This is in order to increase the product identification capability of cans and the like even further.

PATENT DOCUMENT 1: Published Japanese Translation No. 2000-515072 of the PCT International Application

DETAILED DESCRIPTION OF THE INVENTION

Problems to be Solved by the Invention

The present invention was conceived in view of the above described circumstances and it is a first object thereof to provide a can body manufacturing method, a can body, and a can body manufacturing apparatus that make it possible to satisfactorily carry out convexly shaped embossing processing that protrudes outwardly in a radial direction from the outer circumferential surface of the drum portion of a can base material. A second object of the present invention is to provide a can body manufacturing method, a can body, and a can body manufacturing apparatus that make it possible to satisfactorily achieve well-defined embossing processed portions that stand sharply upright in the radial direction from the circumferential surface of the drum portion of a can base and allow a plurality of embossing processed portions to be formed in a tight grouping in a small area. A third object of the present invention is to provide a can body manufacturing method, a can body, and a can body manufacturing apparatus that make it possible to satisfactorily recognize ridgelines in folded portions.

Means for Solving the Problem

In order to solve the above described problems and achieve the above described objects, the can body manufacturing method of the present invention in which there are provided a first rotating body and a second rotating body that are supported so as to be able to rotate around rotation axes that are parallel with each other, and in which a can body is formed by creating embossing processed portions on a drum portion of the can body by placing the first rotating body inside a cylindrical can base having one closed end, and placing the second rotating body outside the can base, and then moving the first and second rotating bodies towards each other and, in a state in which the drum portion of the can base is sandwiched between respective outer circumferential surfaces of these rotating bodies, rotating the first and second rotating bodies around their rotation axes includes: forming a first concave portion that is recessed inwardly in a radial direction on an outer circumferential surface of the first rotating body; forming a first convex portion that protrudes outwardly in the radial direction in the first concave portion; forming a second convex portion that protrudes outwardly in the radial direction on an outer circumferential surface of the second rotating body in a portion that corresponds to the first concave portion; forming a second concave portion that is recessed inwardly in the radial direction in a portion of the second convex portion that corresponds to the first convex portion; pushing the drum portion by the second convex portion from the outer circumferential surface side thereof inwardly in the radial direction such that at least some of the total amount of deformation in this direction becomes elastic deformation when the drum portion is sandwiched between the outer circumferential surfaces of the first and second rotating bodies; fitting the first convex portion to the second concave portion via the drum portion in a state where the inner circumferential surface side that corresponds to elastically deformed portion has been pushed into the first concave portion; thereafter, moving the drum portion that corresponds to the first concave portion and the second convex portion is moved restoratively outwards in the radial direction by the elastic restorative force of the drum portion when the sandwiching between the outer circumferential surfaces of the first and second rotating bodies is stopped; and positioning the outer circumferential surface of that portion of the drum portion that corresponds to the first convex portion and the second concave portion further towards the outer side in the radial direction than the outer circumferential surface of the drum portion excluding those portions that correspond to the first convex portion and the second concave portion.

In this case, because the sandwiching of the drum portion between the first and second rotating bodies is cancelled and the drum portion that corresponds to the first concave portion and second convex portion is moved restoratively towards the outer side in the radial direction by the elastic restorative force of the drum portion, it is possible to easily and reliably form an embossing processed portion that protrudes outwardly in the radial direction on the outer circumferential surface of the drum portion of the can base. Namely, because a gap is formed between the inner circumferential surface of the embossing processed portion and the first convex portion due to this restorative movement, it is possible to largely prevent the first convex portion becoming caught on the inner circumferential surface of the embossing processed portion when the first rotating body is pulled out from the can base.

It may be arranged such that the outermost radial surface of the first convex portion be positioned closer to the inner side in the radial direction than the surface of non-formation portions of the first concave portion. In this case, there is no increase in the outer diameter of the first rotating body as a result of the first convex portion having been formed in order to form the embossing processed portion on the drum portion. Accordingly, during the embossing processing, when the first rotating body is inserted inside the can base, it is possible to prevent the first rotating body colliding with aperture end portions of the can base. Furthermore, during the insertion, instead of the first convex portion, non-formation portions of the first convex portion function as a guide portion for guiding the inner circumferential surface of the can base. Accordingly, even if only a small proportion of the total outer circumferential surface of the first rotating body is occupied by the first convex portion, it is still possible for the guide function of the first rotating body to be sufficiently demonstrated.

Moreover, when the sandwiching of the drum portion between the first and second rotating bodies is cancelled, portions of the inner circumferential surface of the drum portion that correspond to the first concave portion and the second convex portion, excluding those portions that correspond to the first convex portion and the second concave portion, may be moved restoratively further towards the outer side in the radial direction than the outermost surface in the radial direction of the first convex portion. In this case, it is possible to reliably prevent the first convex portion becoming caught on the inner circumferential surface of the embossing processed portion when the first rotating body is pulled out from the can base after the embossing processing.

Furthermore, according to a can body that is manufactured using the can body manufacturing method of the present invention, because the embossing processed portion protrudes outwardly in the radial direction from the outer circumferential surface of the drum portion, this can body can be furnished with product identification capabilities. Moreover, because the embossing processed portion is moved as a result of the restorative movement, plastically deformed portions can be limited to the embossing processed portions so that it becomes possible to control any reduction in the buckling strength of the can body and control any breakages and the like in the coating film that is formed on the inner and outer surfaces of the can body. In addition, when a plurality of can bodies are placed on a conveyor and are transported collectively, it is possible to suppress the occurrence of what is known as 'blocking'.

Moreover, the can body manufacturing method of the present invention in which there are provided a first rotating body and a second rotating body that are supported so as to be able to rotate around rotation axes that are parallel with each other, and in which a can body is formed by creating embossing processed portions on a drum portion of the can body by forming a concave portion that is recessed inwardly in the radial direction or a convex portion that protrudes outwardly in the radial direction or a concave portion and a convex portion on an outer circumferential surface of each of the rotating bodies, and by placing the first rotating body inside a cylindrical can base having one closed end, and placing the second rotating body outside the can base, and then moving the first and second rotating bodies towards each other and, then sandwiching the drum portion of the can base between the respective outer circumferential surfaces of these rotating bodies such that the convex portion is fitted inside the concave portion via the drum portion, and, in this state, by then rotating the first and second rotating bodies around their rotation axes, includes: forming the first and second rotating bodies which is made from urethane resin having a Shore D hardness of not less than 65 and not more than 85; and closely contacting wall surfaces forming the convex portion with wall surfaces forming the concave portion via the drum portion when the drum portion is sandwiched between the outer circumferential surfaces of the first and second rotating bodies, in a state where at least the convex portion and the concave portion are elastically deformed towards the inner side in the radial direction of the respective rotating bodies.

In this case, when the drum portion is sandwiched between the respective outer circumferential surfaces of the first and second rotating bodies, because the wall surfaces forming the convex portion are in close contact via the drum portion with the wall surfaces forming the concave portion, during this sandwiching, the embossing processing can be conducted with the drum portion that is located between the convex portion and the concave portion in a state of being restrained by the wall surfaces that form both the convex portion and the concave portion. Accordingly, during this sandwiching, the drum portion that is positioned between the upright surface portions of the wall surface forming the convex portion that stand upright from the outer circumferential surface of one of the rotating bodies extending outwardly in the radial direction and the inner wall surface portions of the wall surface forming the concave portion that face the upright surfaces and extend inwardly in the radial direction from the outer circumferential surface of the other one of the rotating bodies does not become pulled in a radial direction in an unrestrained state. As a result, due to the deformation behavior of the drum portion during the sandwiching, it is possible to restrict to a minimum the load acting on the ridgeline portions where the upright surfaces and the outermost surfaces in the radial direction of the convex portion intersect, and it is possible to limit abrasion of this ridgeline portion. In addition, it is possible to limit the occurrence of defects such as breakages of the convex portion.

Furthermore, because the embossing processing is performed while the inner and outer circumferential surfaces of the drum portion located between the inner wall surfaces that form the concave portion and the upright surfaces of the convex portion that face these inner wall surfaces are constrained by these upright surfaces and the inner wall surfaces, the embossing processed portion can be formed in the shape of the respective wall surfaces of the convex portion and the concave portion. Accordingly, by causing the upright surfaces and the inner wall surfaces to each extend sharply in the radial direction from the outer circumferential surfaces of the respective rotating bodies, it is possible to reliably form an embossing processed portion that stands sharply upright in the radial direction from the circumferential surface of the drum portion. In particular, during the sandwiching, because at least the convex portion and the concave portion are both elastically deformed towards the inner side in the radial direction of the respective rotating bodies, the sharp shape of the convex portion and the concave portion can be reliably imparted to the drum portion of the can base. Furthermore, as a result of it being possible to form this type of embossing processed portion, the distance between adjacent embossing processed portions can be decreased, and it becomes possible to perform what is known as fine processing in which a plurality of embossing processed portions are formed in a tight group.

It should be noted that when the convex portion or concave portion is engaged with the embossing processed portion of the drum portion, then even if the two rotating bodies are moved apart from each other so that their sandwiching is cancelled, it can be imagined that malfunctions may occur such as the formed can body not separating from the outer circumferential surface of the respective rotating bodies.

However, because the first and second rotating bodies are formed from the aforementioned urethane resin, and the embossing processed portion is formed while the convex portion and the concave portion are in a state of elastic deformation, when the sandwiching of the drum portion by the first and second rotating bodies is cancelled, the elastic deformation of the convex portion and the concave portion is also cancelled, and the convex portion and the concave portion are moved restoratively towards the outer side in the radial direction of the respective rotating bodies. Accordingly, while the inner circumferential surface of the drum portion is moved outwardly in the radial direction by the restorative movement, the outer circumferential surface is moved inwardly in the radial direction so that when the sandwiching is cancelled, the engagement between the embossing processed portion and the convex portion or concave portion can also be cancelled and it is possible to prevent any malfunction from occurring.

Furthermore, it can also be imagined that malfunctions may occur such as the coating film that is formed on the inner and outer circumferential surfaces of the can body being scratched by the convex portion or concave portion.

However, because the first and second rotating bodies are formed from the urethane resin, it becomes possible to restrict to a minimum the load that is acting on the inner and outer circumferential surfaces of the can base during embossing processing, and it is possible to substantially prevent any scratching of the coating film.

Furthermore, it may be arranged such that the convex portion be formed on the outer circumferential surface of the first rotating body, and for the concave portion to be formed on the outer circumferential surface of the second rotating body.

In this case, it becomes possible to form the convex embossing processed portion, which protrudes outwardly in the radial direction on the outer circumferential surface of the can base, such that it rises up sharply from the outer circumferential surface of the can base. It is thus possible to form a can body that has a particularly pleasing appearance and also has product identification capabilities.

Moreover, it may be arranged such that the first concave portion that is recessed inwardly in the radial direction be formed on the outer circumferential surface of the first rotating body, and the first convex portion that protrudes outwardly in the radial direction is formed in the first concave portion, the second convex portion that protrudes outwardly in the radial direction be formed on the outer circumferential surface of the second rotating body in a portion that corresponds to the first concave portion, and the second concave portion that is recessed inwardly in the radial direction is formed in a portion of the second convex portion that corresponds to the first convex portion, when the drum portion is sandwiched between the outer circumferential surfaces of the first and second rotating bodies, the drum portion be pushed by the second convex portion from the outer circumferential surface side thereof inwardly in the radial direction such that at least some of the total amount of deformation in this direction becomes elastic deformation, in a state in which the inner circumferential surface side that corresponds to elastically deformed portion has been pushed into the first concave portion, the first convex portion be fitted inside the second concave portion via the drum portion, thereafter, when the sandwiching between the outer circumferential surfaces of the first and second rotating bodies is cancelled, the drum portion that corresponds to the first concave portion and the second convex portion be moved restoratively outwards in the radial direction by the elastic restorative force of the drum portion, and the outer circumferential surface of the drum portion that corresponds to the first convex portion and the second concave portion be positioned further towards the outer side in the radial direction than the outer circumferential surface of the drum portion excluding those portions that correspond to the first convex portion and the second concave portion.

In this case, because the sandwiching of the drum portion between the first and second rotating bodies is cancelled and the drum portion that corresponds to the first concave portion and second convex portion is moved restoratively towards the outer side in the radial direction by the elastic restorative force of the drum portion, it is possible to easily and reliably form a convex embossing processed portion that protrudes outwardly in the radial direction on the outer circumferential surface of the drum portion of the can base and that rises up sharply from this outer circumferential surface. Namely, because a gap is formed between the inner circumferential surface of the embossing processed portion and the first convex portion due to this restorative movement, it is possible to largely prevent the first convex portion becoming caught on the inner circumferential surface of the embossing processed portion when the first rotating body is pulled out from the can base.

Furthermore, in a can body that is obtained using the above described can body manufacturing method, plastically deformed portions can be limited to the embossing processed portions so that it becomes possible to control any reduction in the buckling strength of the can body and to suppress the occurrence of what is known as 'blocking' when a plurality of can bodies are placed on a conveyor and are transported collectively.

It may be arranged such that the depth of the first concave portion be greater than the height of the first convex portion.

In this case, because the portion where the outer diameter is the largest on the outer circumferential surface of the first rotating body is not the first convex portion, but is the non-formation areas of the first concave portion, there is no increase in the outer diameter of the first rotating body due to the fact that the first convex portion has been formed in order to form the embossing processed portion on the drum portion. Accordingly, when the first rotating body is inserted inside the can base during the embossing processing, it is possible to avoid a situation in which the first rotating body collides with the aperture end portions of the can base. Furthermore, during the above described insertion, instead of the first convex portion, the non-formation portions of the first concave portion function as guide portions to guide the inner circumferential surface of the can base. Accordingly, even if only a small proportion of the entire outer circumferential surface of the first rotating body is occupied by the first convex portion, it is still possible for the guiding function of the first rotating body to be sufficiently demonstrated.

According to the can body that is formed using this can body manufacturing method, because the embossing processed portion protrudes outwardly in the radial direction from the outer circumferential surface of the drum portion and rises sharply upwards from this outer circumferential surface, it is possible to equip this can body with product identification capabilities, and it is possible to suppress any breaking of the coating film that is formed on the inner and outer surfaces of the can body.

Furthermore, the can body manufacturing method of the present invention in which a can body is formed by creating embossing processed portions on a drum portion of the can body by placing one of a first rotating body and a second rotating body that are supported so as to be able to rotate around rotation axes that are parallel with each other inside a cylindrical can base having one closed end, while placing the other of the first and second rotating bodies outside the can base, and then moving the first and second rotating bodies towards each other and, sandwiching the drum portion of the can base between respective outer circumferential surfaces of these rotating bodies, and rotating the first and second rotating bodies around their rotation axes, includes: forming a first concave portion that is recessed inwardly in a radial direction on an outer circumferential surface of the first rotating body; forming a first bent concave portion that is recessed inwardly in the radial direction in the first concave portion via a first convex curved surface portion; forming a first convex portion that protrudes outwardly in the radial direction on an outer circumferential surface of the second rotating body at a position corresponding to the first concave portion, forming a first bent convex portion that protrudes outwardly in the radial direction at a position of the first convex portion that corresponds to the first bent concave portion via a first concave curved surface portion; pushing one circumferential surface of the drum portion by the first convex portion inwardly in the radial direction of the first rotating body so that the other circumferential surface side of the drum portion that corresponds to the one circumferential surface of the drum portion is pushed into the first concave portion when the drum portion is sandwiched between the outer circumferential surfaces of the first and second rotating bodies; pushing the drum portion by the first convex curved surface portion from the other circumferential surface side thereof into the first concave curved surface portion while the first bent convex portion being inserted into the first bent concave portion via the drum portion; plastically deforming a portion of the drum portion that corresponds to the first bent convex portion and the first bent concave portion so as to protrude inwardly in the radial direction of the first rotating body, and elastically deforming a portion of the drum portion that corresponds to the first convex curved surface portion and the first concave curved surface portion by a greater deformation amount than the shape of the can body towards the outer side in the radial direction of the first rotating body.

In this case, because portions of the drum portion that correspond to the first convex curved surface portion and the first concave curved surface portion are elastically deformed towards the outer side in the radial direction of the first rotating body by a larger deformation amount than the shape of the can body, and because the drum portion is inserted by the first bent convex portion into the first bent concave portion, it is possible to provide a sufficient amount of distortion to plastically deform and bend the inserted portion of the drum portion.

When the sandwiching is cancelled, there is a possibility that the bent portions may sag as a result of those portions that are peripheral to the portion of the drum portion that is sandwiched between the first bent concave portion and the first bent convex portion and bent (referred to below as the 'bent portion'), namely, those portions that are pushed by the first convex curved surface portion against the first concave curved surface portion being moved restoratively by their own elastic deformation.

However, in the present invention, with consideration given to the this type of restorative movement, because the drum portion is pushed against the first concave curved surface portion by the first convex curved surface portion so that the portions that are peripheral to the bent portion are elastically deformed in advance by a greater amount than the shape of the can body, it is possible to prevent sagging occurring in the bent portions even if the portions that are peripheral to the bent portion make the restorative movement.

As a result of the above, even if there is only a small amount of concavity and convexity in a bent portion, a can body can still be obtained that makes it possible to excellently visualize the ridgeline of this bent portion.

Furthermore, even if the first rotating body is placed inside the can base and a bent portion is formed so as to protrude towards the inner side in the radial direction of the can base, when the sandwiching is cancelled, because the portion that is pressed by the first convex curved surface portion against the first concave curved surface portion is moved restoratively due to the elastic deformation, it is still possible to easily pull the first rotating body from inside the can body without the first rotating body becoming caught on the bent portion.

It may be arranged such that at least one second convex portion that protrudes outwardly in the radial direction be formed on an outer circumferential surface of the first rotating body adjacent to the first concave portion, a second bent convex portion that protrudes outwardly in the radial direction be formed via a second concave curved surface portion in the second convex portion, a second concave portion that is recessed inwardly in the radial direction be formed on an outer circumferential surface of the second rotating body at a position corresponding to the second convex portion, a second bent concave portion that is recessed inwardly in the radial direction be formed via a second convex curved surface portion at a position of the second concave portion that corresponds to the second bent convex portion, when the drum portion is sandwiched between the outer circumferential surfaces of the first and second rotating bodies, the other circumferential surface of the drum portion is pushed by the second convex portion inwardly in the radial direction of the second rotating body so that the one circumferential surface side of the drum portion that corresponds to the other circumferential surface of the drum portion is pushed into the second concave portion, the drum portion is pushed by the second convex curved surface portion from the one circumferential surface side thereof into the second concave curved surface portion while the second bent convex portion being inserted into the second bent concave portion via the drum portion, a portion of the drum portion that corresponds to the second bent convex portion and the second bent concave portion is plastically deformed so as to protrude inwardly in the radial direction of the second rotating body, and a portion of the drum portion that corresponds to the second convex curved surface portion and the second concave curved surface portion is elastically deformed by a greater deformation amount than the shape of the can body towards the outer side in the radial direction of the second rotating body.

In this case, in addition to the same operation and effects as those described above being obtained, because the bent portion that is formed by the second bent convex portion and the second bent concave portion protruding in the opposite direction from the above described bent portion that is formed by the first bent concave portion and the first bent convex portion, the respective bent portions can be visually emphasized and their respective ridgelines can be viewed even more clearly.

Moreover, it may be arranged such that the first and second rotating bodies be formed from a urethane material having a Shore D hardness of not less than 65 and not more than 85.

In this case, it is possible to avoid damage to a coating film that is formed on the inner and outer circumferential surfaces of a drum portion when it is sandwiched.

Furthermore, it may be arranged such that, when the drum portion is sandwiched between the outer circumferential surfaces of the first and second rotating bodies, in a state in which at least the first convex curved surface portion, the first concave curved surface portion, the second convex curved surface portion, and the second concave curved surface portion be each elastically deformed inwardly in the radial direction of the rotating bodies, the first convex curved surface portion and the second convex curved surface portion be pushed respectively via the drum portion into the first concave curved surface portion and the second concave curved surface portion.

In this case, it is possible to form a bent portion that can be even more clearly visualized. In addition, when the sandwiching is cancelled, because the first convex curved surface portion and the first concave curved surface portion are each moved restoratively towards the circumferential surface of the can body, it is possible to reliably restrict the formed bent portion becoming caught on the first convex portion or the first concave portion.

Furthermore, the can body manufacturing apparatus of the present invention includes: a first rotating body and a second rotating body that are supported so as to be able to rotate around rotation axes that are parallel with each other; wherein a concave portion that is recessed inwardly in the radial direction or a convex portion that protrudes outwardly in the radial direction or a concave portion and a convex portion are formed on an outer circumferential surface of each of the rotating bodies, and a can body is formed by creating embossing processed portions on a drum portion of the can body by placing the first rotating body inside a cylindrical can base having one closed end, and placing the second rotating body outside the can base, and then moving the first and second rotating bodies towards each other, and then sandwiching the drum portion of the can base between the respective outer circumferential surfaces of these rotating bodies such that the convex portion is fitted inside the concave portion via the drum portion, and, in this state, by then rotating the first and second rotating bodies around their rotation axes, further wherein when the first and second rotating bodies are moved away from each other in the radial direction by the distance of the thickness of the drum portion of the can base from a state in which the respective outer circumferential surfaces of the first and second rotating bodies are in contact with each other, the gap between the wall surface of the convex portion and the wall surface of the concave portion which are included in the wall surfaces that respectively form each of the convex portion and the concave portion which are facing each other and which are facing each other is substantially equal to the thickness of the drum portion.

In this case, during the sandwiching, it is possible to reliably place the wall surface that form the convex portion in close contact via the drum portion with the wall surfaces that form the concave portion.

It may be arranged such that inner wall surfaces which are included in the wall surfaces that form the concave portion and which extend inwardly in the radial direction from the outer circumferential surface of the rotating body be formed in a tapered shape in which the distance between the two inner wall surfaces that face each other becomes gradually less moving inwardly in the radial direction, and upright surfaces which are included in the wall surfaces that form the convex portion and which extend outwardly in the radial direction from the outer circumferential surface of the rotating body be formed in a tapered shape in which the distance between the two upright surfaces that face each other becomes gradually less moving outwardly in the radial direction.

In this case, when the drum portion of the can base is sandwiched between the respective outer circumferential surfaces of the first and second rotating bodies, and the convex portion is fitted inside the concave portion via the drum portion, then it is possible to lighten the load from the respective wall surfaces that form the convex portion and the concave portion that acts on the inner and outer circumferential surfaces of the drum portion, and it is possible to largely prevent the coating film that is formed on the inner and outer circumferential surfaces of the can base being scratched. In addition when the first and second rotating bodies are moved away from each other after the embossing processing, it is possible to easily cancel the engagement between the embossing processed portion that has been formed and the convex portion or concave portion.

Advantageous Effects of the Invention

According to the present invention, it is possible to achieve excellent convexly shaped embossing processing that protrudes outwardly in a radial direction on an outer circumferential surface of a drum portion of a can base.

Moreover, it is possible to form distinct embossing processed portions that rise up sharply in a radial direction from the circumferential surface of the drum portion of a can base, and to also form a plurality of embossing processed portions in a tight grouping on a limited area.

Furthermore, by elastically deforming in advance those portions that are peripheral to a bent portion by sandwiching them between a first concave portion and a first convex portion, it is possible to reliably plastically deform the bent portion when it is sandwiched between a first bent concave portion and a first bent convex portion. As a result, a ridgeline having excellent visual appeal can be formed.

DESCRIPTION OF THE REFERENCE SYMBOLS

Figure 1:
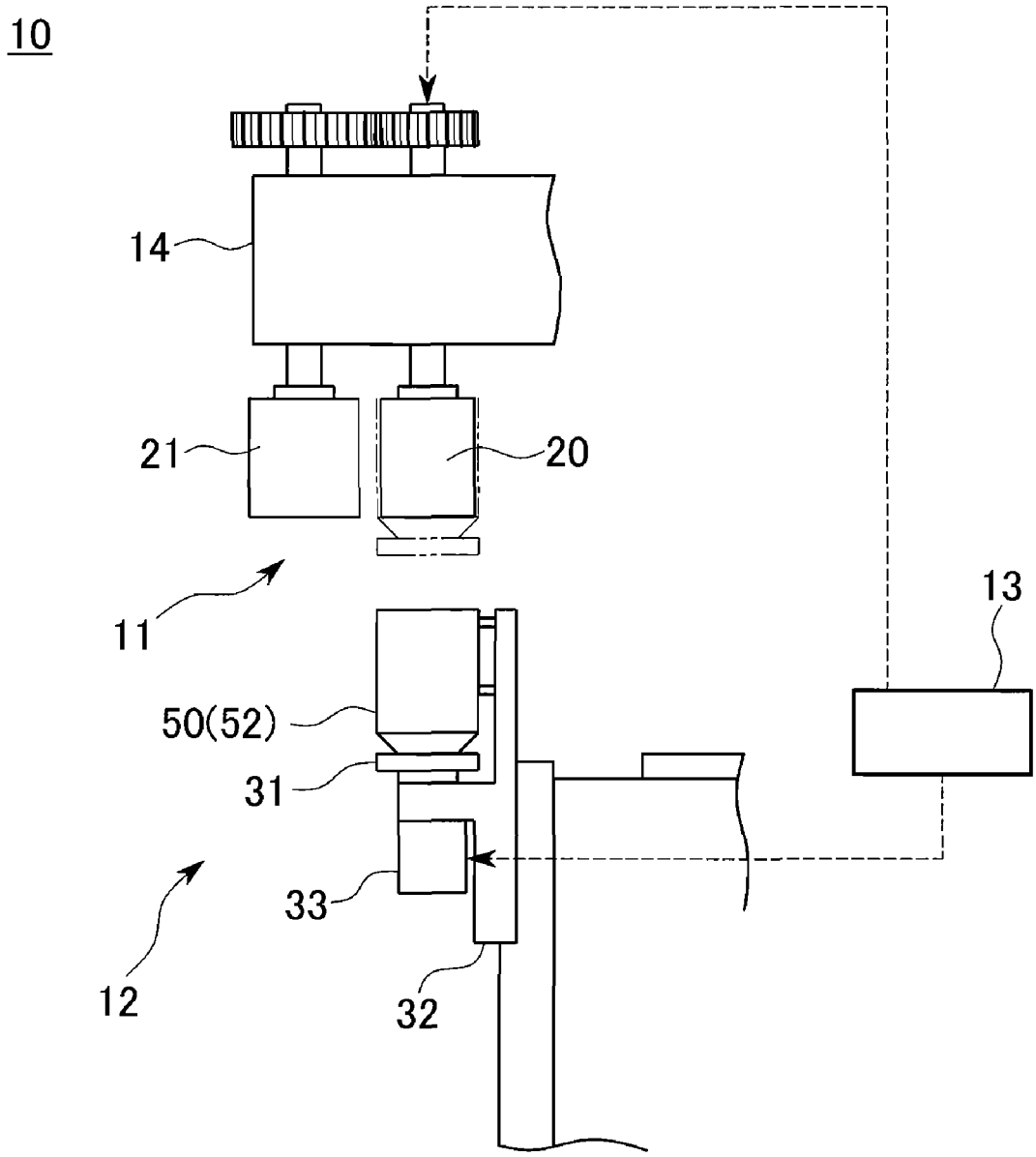
FIG. 1 is a schematic view showing the overall structure of a can body manufacturing apparatus for implementing a can body manufacturing method.

10 Can body manufacturing apparatus
20 First rotating body
20*a*, 61 First concave portion
20*b*, 41 First convex portion
21 Second rotating body
21*a*, 62 Second concave portion
21*b*, 42 Second convex portion
41*a* First concave curved surface portion
42*a* Second convex curved surface portion
43 First folded convex portion
44 Second folded concave portion
50 Can base
52 Can body
61*a* First convex curved surface portion
62*a* Second concave curved surface portion
63 First folded concave portion
64 Second folded convex portion

BEST MODE FOR CARRYING OUT THE INVENTION

Embodiments of this invention will now be described with reference made to the drawings. FIGS. 1 through 5 show the schematic structure of a can body manufacturing apparatus that is shown as the first embodiment of this invention.

As shown in FIG. 1, a can body manufacturing apparatus 10 of this invention is provided with a metal mold portion 11 that presses a drum portion of a can base 50 in a radial direction so as to form an embossing processed portion that protrudes outwards in the radial direction from an outer circumferential surface of the drum portion, a supporting portion 12 that is located beneath the metal mold portion 11 and supports the can base 50 such that it is able to move towards or away from the metal mold portion 11 and is also able to rotate, and a control unit 13 that controls the driving of the metal mold portion 11 and the supporting portion 12.

The metal mold portion 11 is provided with a first rotating body 20 and a second rotating body 21 that are supported so as to be able to rotate around axes of rotation that are parallel to each other, and a first drive portion 14 that causes each of the rotating bodies 20 and 21 to rotate in the opposite direction and in synchronization. Note that the first and second rotating bodies 20 and 21 may be formed, for example, from a metal, and preferably from urethane resin, and more preferably from urethane resin having a Shore D hardness of 65 or more to 85 or less. In the present embodiment, a description is given of a case in which the first and second rotating bodies 20 and 21 are formed from urethane resin having a Shore D hardness of 65 or more to 85 or less.

The supporting portion 12 is provided with a chuck 31 whose structure enables it to hold a bottom surface of a can base 50 or a can body 52, a slide portion 32 that supports this chuck 31 such that it is able to move towards or away from the metal mold portion 11, and a motor portion 33 that supports the chuck 31 such that it is able to rotate around the can axis.

Figure 2:
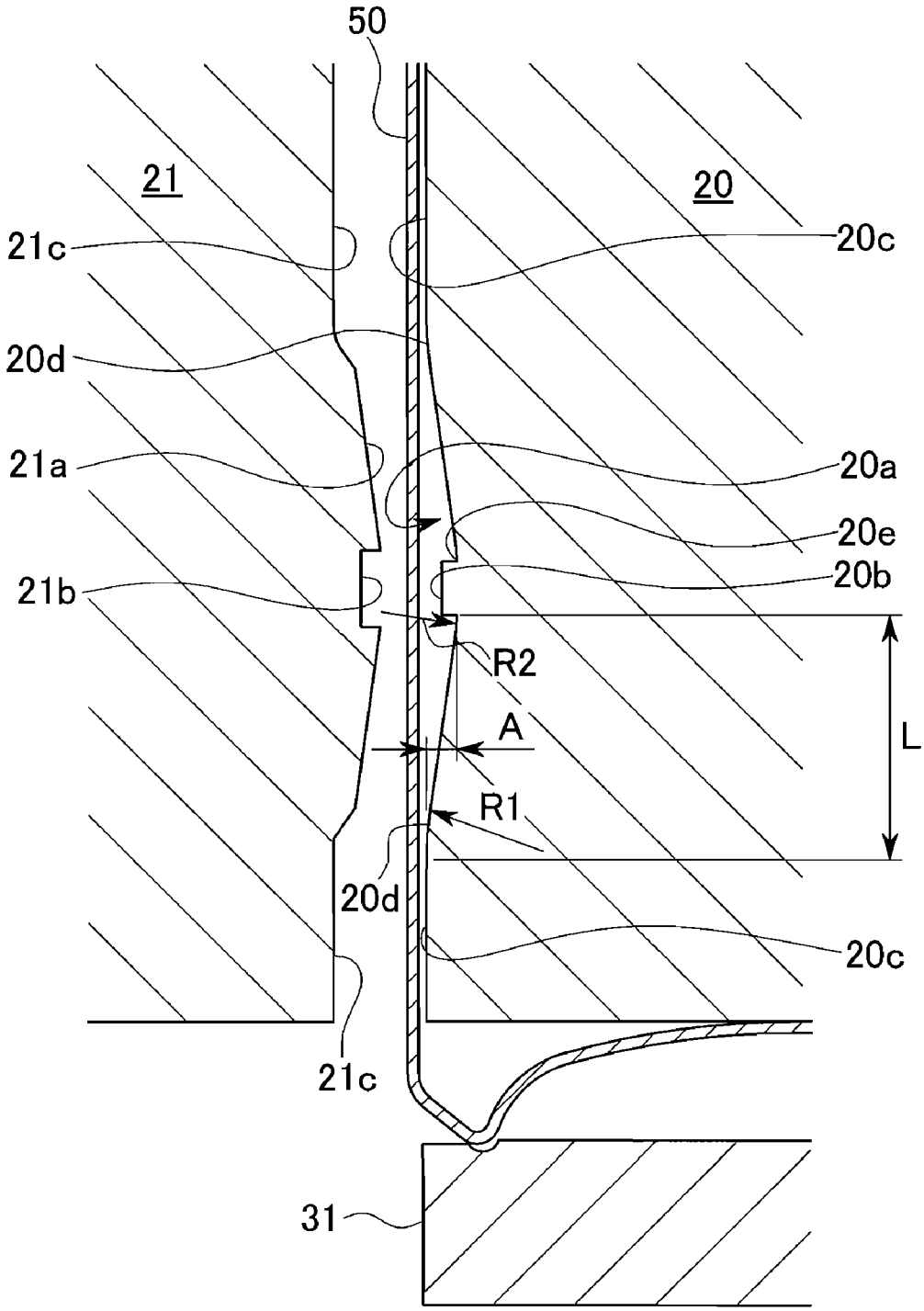
FIG. 2 is a first process drawing when the can body manufacturing method that is shown as an embodiment of the present invention is implemented, and is an enlarged cross-sectional view showing a portion of a first and second rotating body shown in FIG. 1.

In the present embodiment, as shown in FIG. 2, a first concave portion 20*a* that is recessed inwardly in the radial direction is formed on an outer circumferential surface of the first rotating body 20, and a first convex portion 20*b* that protrudes outwardly in the radial direction is formed on a bottom surface of this first concave portion 20*a*. In the example shown in the drawing, the depth of the first concave portion 20*a* is formed greater than the protrusion height in the radial direction of the first convex portion 20*b*, and an outer diameter of a portion 20*c* where the first concave portion 20*a* is not formed on the outer circumferential surface of the first rotating body 20 is formed having the largest size. Moreover, the first convex portion 20*b* is formed in a center portion in the axial direction of the first concave portion 20*a*.

As shown in FIG. 2, a second convex portion 21*a* that protrudes outwardly in the radial direction at a portion corresponding to the first concave portion 20*a* is formed on an outer circumferential surface of the second rotating body 21, and a second concave portion 21*b* that is recessed inwardly in the radial direction is formed in a portion of the second convex portion 21*a* that corresponds to the first convex portion 20*b*.

Figure 5:
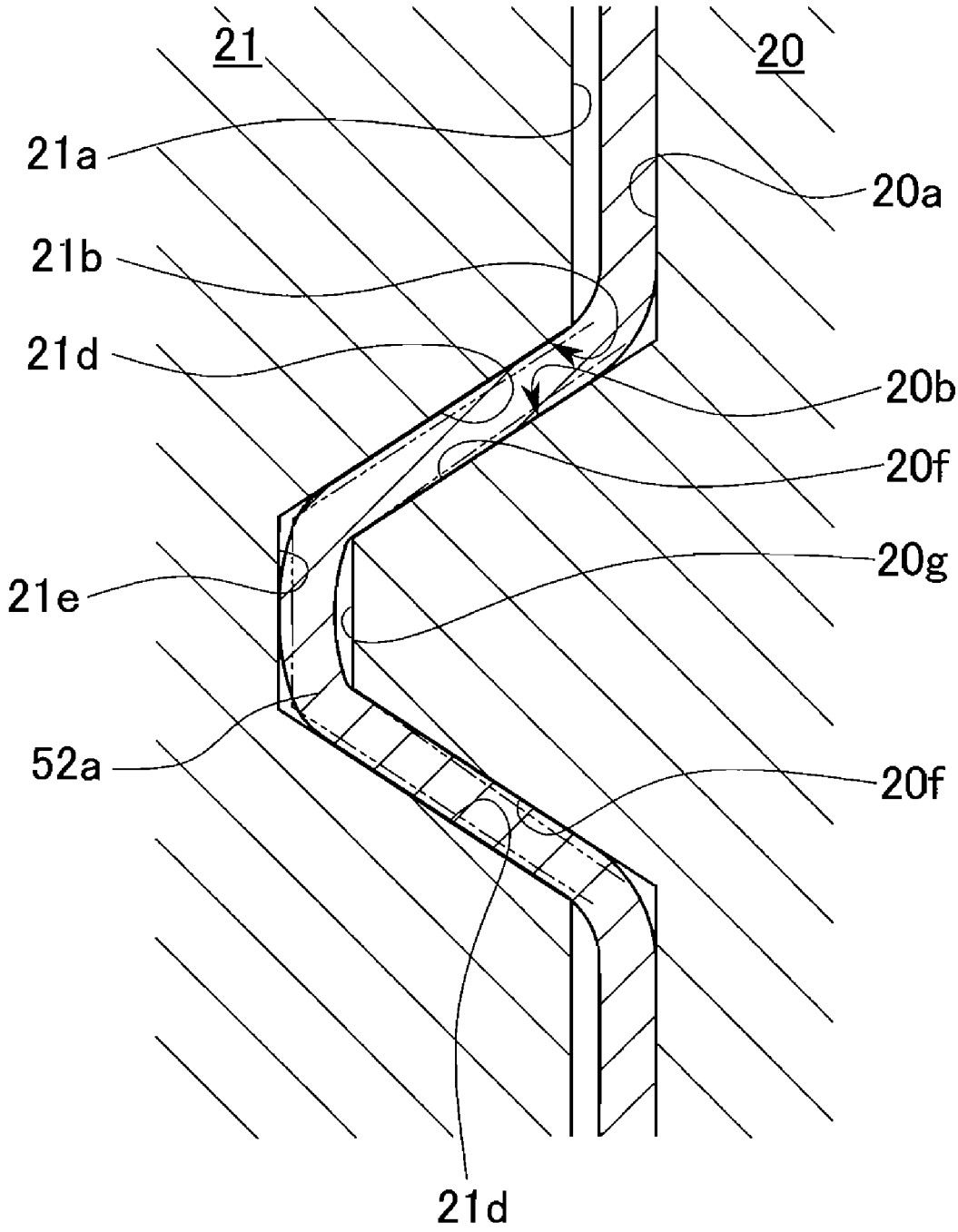
FIG. 5 is an enlarged view showing a first convex portion of the first rotating body and a second concave portion of the second rotating body that are shown in FIG. 3.

As shown in FIG. 5, of the wall surfaces that form the second concave portion 21*b*, inner wall surfaces 21*d* that extend inwards in the radial direction from the outer circumferential surface of the second convex portion 21*a* are formed in a tapered shape in which the distance between the two inner wall surfaces 21*d* and 21*d* that face each other becomes gradually less moving from the outer circumferential surface inwardly in the radial direction of the second rotating body 21. In addition, of the wall surfaces that form the first convex portion 20*b*, upright surfaces 20*f* that extend outwards in the radial direction from the outer circumferential surface of the first concave portion 20*a* are formed in a tapered shape in which the distance between the two wall surfaces 20*f* and 20*f* that face each other becomes gradually less moving from the outer circumferential surface outwardly in the radial direction of the first rotating body 20.

In the above described structure, the size of the first concave portion 20*a* when seen in plan view from the outer side in the radial direction of the first rotating body 20 is greater than the size of the second convex portion 21*a* when seen in plan view from the outer side in the radial direction of the second rotating body 21. Moreover, the size of the first convex portion 20*b* when seen in plan view from the outer side in the radial direction of the first rotating body 20 is smaller than the size of the second concave portion 21*b* when seen in plan view from the outer side in the radial direction of the second rotating body 21.

Namely, as a result of the first and second rotating bodies 20 and 21 moving towards or away from each other, the second convex portion 21*a* of the second rotating body 21 is inserted into or withdrawn from the first concave portion 20*a* of the first rotating body 20, and the first convex portion 20*b* of the first rotating body 20 is inserted into or withdrawn from the second concave portion 21*b* of the second rotating body 21.

Furthermore, in the present embodiment, a structure is employed in which, without inserting the first rotating body 20 into the inside of the can base 50, when the rotating bodies 20 and 21 are moved away from each other in the radial direction by the distance of the thickness of the drum portion of the can base 50 from a state in which the respective outer circumferential surfaces of the first and second rotating bodies 20 and 21, namely, the outer circumferential surface of the non-formation portion 20*c* of the first rotating body 20 and the outer circumferential surface 21*c* of the second rotating body 21 are in contact with each other, then, as shown in FIG. 5, of the wall surfaces that respectively form each of the first convex portion 20*b* and the second concave portion 21*b* which are facing each other, the gap between the wall surface of the first convex portion 20*b* and the wall surface of the second concave portion 21*b* which are facing each other is substantially equal to the thickness of the drum portion.

Namely, in the present embodiment, when the gap between the upright surfaces 20*f* of the first convex portion 20*b* and the inner wall surfaces 21*d* of the second convex portion 21*a* is the same as the thickness of the drum portion, then in spite of the gap between the outermost surface 20*g* of the first convex portion 20*b* and the bottom surface 21*e* of the second concave portion 21*b* being larger than the thickness of the drum portion, this difference is able to be kept to a minimum.

On the outer circumferential surface of the first rotating body 20, as shown in FIG. 2, the non-formation portion 20*c* of the first concave portion 20*a* and the first concave portion 20*a* are smoothly joined via a first convex curved surface portion 20*d* that protrudes outwardly in the radial direction. Moreover, the first concave portion 20*a* and the first convex portion 20*b* are smoothly joined via a first concave curved surface portion 20*e* that is recessed inwardly in the radial direction. In addition, from the first convex curved surface portion 20*d* to the first concave curved surface portion 20*e*, the first concave portion 20*a* is formed in a tapered shape that slopes gradually inwards in the radial direction. Namely, a structure is employed in which the first concave portion 20*a* is formed in a mortar shape, and the first convex portion 20*b* is formed in the deepest portion of this mortar.

Note that a radius of curvature R1 of the first convex curved surface portion 20*d* is not less than 14 mm and not more than 160 mm, while a radius of curvature R2 of the first concave curved surface portion 20*e* is not less than 14 mm and not more than 160 mm. Moreover, a distance L in the axial direction between the first convex curved surface portion 20*d* and the first concave curved surface portion 20*e* is not less than 7 mm and not more than 25 mm, and the distance in the radial direction from the deepest position (i.e., the portion located on the innermost side in the radial direction) of the first concave portion 20*a* to the non-formation portion 20*c*, namely, a depth A of the first concave portion 20*a* is not less than 0.4 mm and not more than 1.4 mm.

Next, a description will be given of a method of forming an embossing processed portion in a drum portion of a can base 50 using a can body manufacturing apparatus having the above described structure.

When a can base 50 is transported to the can body manufacturing apparatus 10, firstly, the bottom surface of the can base material 50 is held in the chuck 31. The motor portion 33 is then driven to rotate and, in conjunction with this, the can base 50 is rotated around the can axis. As a result, the can base 50 is positioned around the can axis.

The can base 50 is then moved forwards in the can axial direction towards the metal mold portion 11 via the slide portion 32 of the supporting portion 12, and the first rotating body 20 is inserted into the inner side of the can base 50. As a result, as shown in FIG. 2, the first rotating body 20 is placed inside the can base 50, and the second rotating body 21 is placed outside the can base 50. Next, the first and second rotating bodies 20 and 21 are made to approach each other so that the drum portion of the can base 50 is sandwiched between the respective outer circumferential surfaces of the rotating bodies 20 and 21. In this state, if the first and second rotating bodies 20 and 21 are rotated around their axes of rotation, embossing processing is performed on the drum portion of the can base 50 so as to form the embossing processed portion. The first and second rotating bodies 20 and 21 are then moved away from each other, and the supporting portion 12 is then removed from the metal mold portion 11. The first rotating body 20 is then withdrawn from the inside of the can body 52. Note that the first and second rotating bodies 20 and 21 sandwich the drum portion of the can base 50 with a force of not less than 1000N and not more than 3500N.

Figure 3:
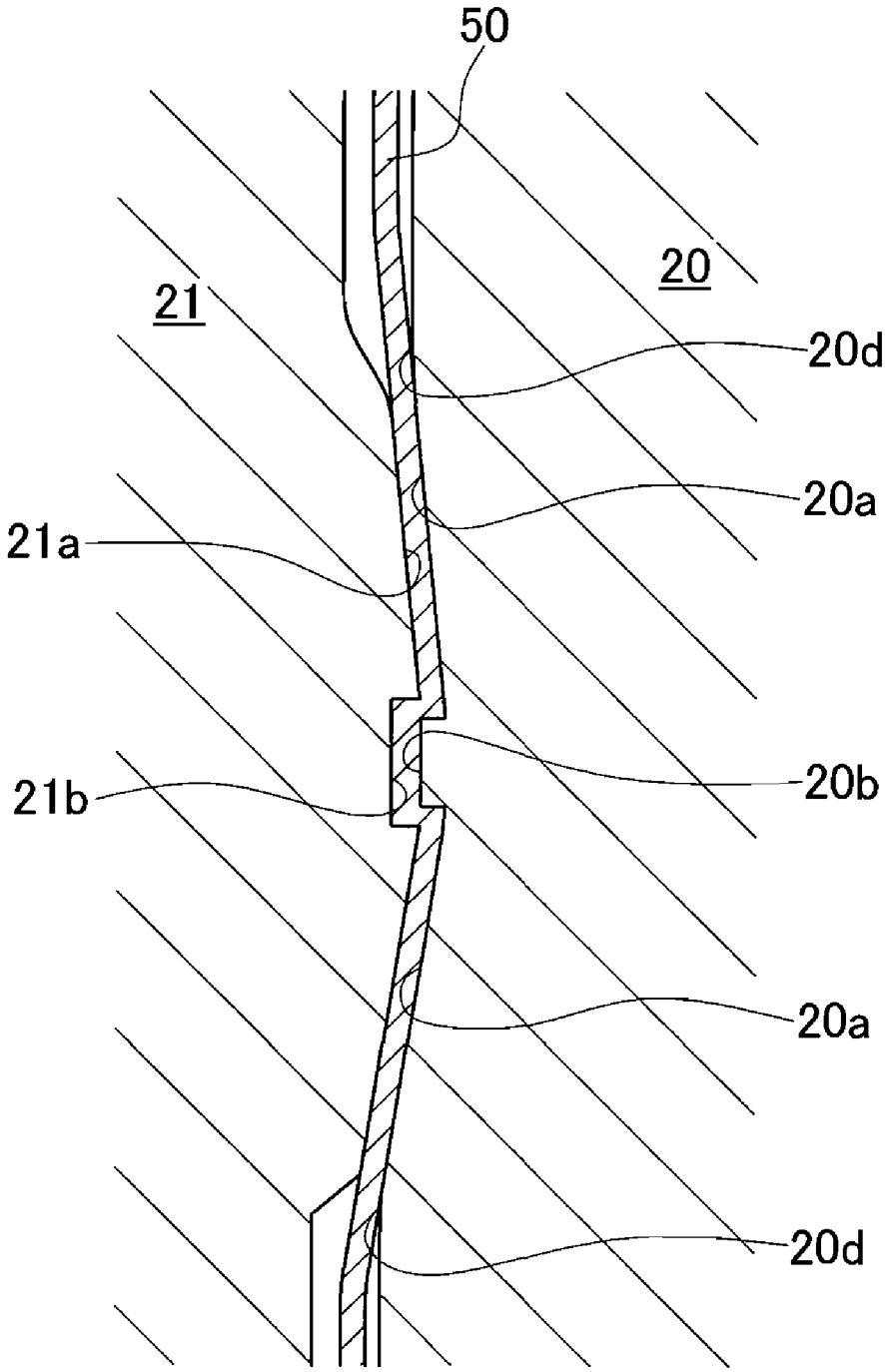
FIG. 3 is a second process drawing when the can body manufacturing method that is shown as an embodiment of the present invention is implemented, and is an enlarged cross-sectional view showing a portion of a first and second rotating body shown in FIG. 1.

When the drum portion is sandwiched between the outer circumferential surfaces of the first and second rotating bodies 20 and 21, the drum portion is pressed by the second convex portion 21*a* from the outer circumferential surface side thereof towards the inner side in the radial direction so that at least some of the total amount of deformation in this direction is elastic deformation, and, as shown in FIG. 3, in a state in which the inner circumferential surface side that corresponds to this is inserted into the first concave portion 20*a*, the first convex portion 20*b* is fitted into the second concave portion 21*b* via the drum portion.

Namely, of the drum portion of the can base material 50, in the portions that correspond to both the first concave portion 20*a* excluding the first convex portion 20*b* and the second convex portion 21*a* excluding the second concave portion 21*b* (referred to below as 'portions peripheral to the embossing processed portion'), distortion that is generated dependently on the tapered shape of the first convex curved surface portion 20*d* and the first concave portion 20*a* does not exceed a deformation that is within elastic limits, and it is possible to avoid the portions peripheral to the embossing processed portion being plastically deformed. In contrast, because the first convex portion 20*b* is fitted inside the second concave portion 21*b* via the drum portion, those portions of the drum portion that correspond to both the first convex portion 20*b* and the second concave portion 21*b* are deformed to such an extent that they enter the region of plastic deformation, and are plastically deformed.

Furthermore, when the first convex portion 20*b* is fitted inside the second concave portion 21*b* via the drum portion, as shown in FIG. 3 and FIG. 5, the wall surfaces 20*f*, 20*f*, and

20*g* that form the first convex portion 20*b* are placed in close contact via the drum portion with the wall surfaces 21*d*, 21*d*, and 21*a* that form the second concave portion 21*b*. Furthermore, at this time, as shown by the double-dot chain line in FIG. 5, the upright surfaces 20*f* and 20*f* of the first convex portion 20*b* and the inner wall surfaces 21*d* and bottom surface 21*e* of the second concave portion 21*b* are elastically deformed towards the inner side in the radial direction of the respective rotating bodies 20 and 21.

Figure 4:
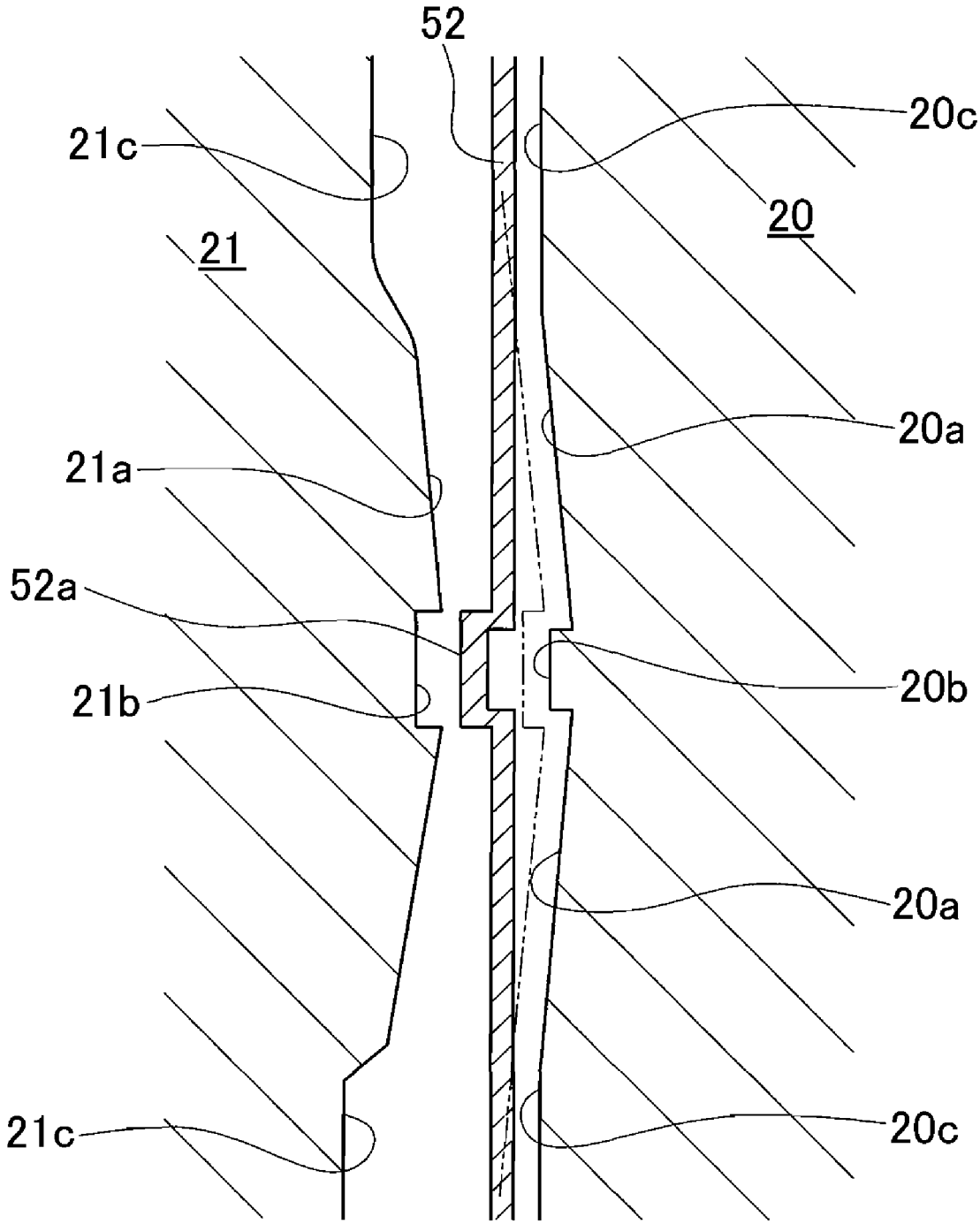
FIG. 4 is a third process drawing when the can body manufacturing method that is shown as an embodiment of the present invention is implemented, and is an enlarged cross-sectional view showing a portion of a first and second rotating body shown in FIG. 1.

As a result of the above, when the sandwiching of the drum portion between the first and second rotating bodies 20 and 21 is cancelled, as shown in FIG. 4, the drum portion that corresponds to the first concave portion 20*a* and second convex portion 21*a* undergoes a restorative movement towards the outer side in the radial direction due to the elastic restorative force of the drum portion. In addition, the outer circumferential surface of the portion of the drum portion that corresponds to the first convex portion 20*b* and second concave portion 21*b* (i.e., the embossing processed portion 52*a*) becomes positioned further towards the outer side in the radial direction than the outer circumferential surface of the drum portion excluding those portions that correspond to the first convex portion 20*a* and second concave portion 21 (i.e., those portions corresponding to the non-formation portions 20*c* and 21*c*).

Furthermore, in the present embodiment, portions of the inner circumferential surface of the drum portion that correspond respectively to the first concave portions 20*a* and the second convex portions 21*a*, excluding those portions that correspond respectively to the first convex portion 20*b* and the second concave portion 21*b* (i.e., the embossing processed portion 52*a*), are moved restoratively further towards the outer side in the radial direction than the outermost surface in the radial direction of the first convex portion 20*b*.

Furthermore, at this time, due to the respective elastic restorative forces of the first convex portion 20*b* of the first rotating body 20 and the second concave portion 21*b* of the second rotating body 21, the first convex portion 20*b* and the second concave portion 21*b* are moved restoratively towards the outer side in the radial direction of the respective rotating bodies 20 and 21.

As has been described above, according to the can body manufacturing method and can body manufacturing apparatus of the present embodiment, when the sandwiching of the drum portion between the first and second rotating bodies 20 and 21 is cancelled, the drum portion that corresponds to the first concave portion 20*a* and second convex portion 21*a* is moved restoratively towards the outer side in the radial direction by the elastically restorative force of the drum portion. As a result, it becomes possible to easily and reliably form the embossing processed portion 52*a* which protrudes towards the outer side in the radial direction from the outer circumferential surface of the drum portion of the can base 50.

Namely, because a gap is formed between the first convex portion 20*b* and the inner circumferential surface of the embossing processed portion 52*a* of the drum portion due to the above described restorative movement, when the first rotating body 20 is withdrawn from the can base 50, it becomes possible to substantially prevent the first convex portion 20*b* becoming caught on the inner circumferential surface of the embossing processed portion 52*a*.

Moreover, because the depth of the first concave portion 20*a* is greater than the height to which the first convex portion 20*b* protrudes, the outermost radial surface of the first convex portion 20*b* is positioned further towards the inner side in the radial direction than the surface of the non-formation portions 20*c*, and there is no increase in the outer diameter of the first rotating body 20 due to the fact that the first convex portion 20*b* has been formed in order to form the embossing processed portion 52*a* on the drum portion.

Accordingly, when the first rotating body 20 is inserted inside the can base 50, it is possible to avoid a situation in which the first rotating body 20 collides with the aperture end portions of the can base 50. Furthermore, during the above described insertion, instead of the first convex portion 20*b*, the non-formation portions 20*c* of the first concave portion 20*a* function as guide portions to guide the inner circumferential surface of the can base 50. Accordingly, even if only a small proportion of the entire outer circumferential surface of the first rotating body 20 is occupied by the first convex portion 20*b*, it is still possible for the guiding function of the first rotating body 20 to be sufficiently demonstrated.

Furthermore, when the sandwiching of the drum portion between the first and second rotating bodies 20 and 21 is cancelled, because the portions of the inner circumferential surface of the drum portion that correspond to both the first concave portions 20*a* and the second convex portions 21*a*, excluding the portion that corresponds to the first convex portion 20*b* and the second concave portion 21*b*, are moved restoratively by the above described elastic restorative force further towards the outer side in the radial direction than the outermost surface in the radial direction of the first convex portion 20*b*, when the first rotating body 20 is withdrawn from the can base 50 after the embossing processing, it becomes possible to reliably restrict the first convex portion 20*b* from becoming caught on the inner circumferential surface of the embossing processed portion 52*a* of the drum portion.

Moreover, in a can body that is formed in this manner, because the embossing processed portion 52*a* protrudes towards the outer side in the radial direction from the outer circumferential surface of the drum portion, it is possible to furnish this can body with product identification capabilities. Moreover, because the embossing processed portion 52*a* is formed as a result of undergoing the aforementioned restorative movement, it becomes possible to limit the plastically deformed portion to the embossing processed portion 52*a*, so that it becomes possible to control any reduction in the buckling strength of the can body and control any breakages and the like in the coating film that is formed on the inner and outer surfaces of the can body. In addition, when a plurality of can bodies are placed on a conveyor and are transported collectively, it is possible to suppress the occurrence of what is known as 'blocking'.

Furthermore, in the present embodiment, when the drum portion is sandwiched between the respective outer circumferential surfaces of the first and second rotating bodies 20 and 21, because the wall surfaces forming the first convex portion 20*b* are in close contact via the drum portion with the wall surfaces forming the second concave portion 21*b*, during this sandwiching, the embossing processing can be conducted with the drum portion that is located between the convex portion 20*b* and the concave portion 21*b* in a state of being restrained by the wall surfaces that form both the first convex portion 20*b* and the second concave portion 21*b*.

Accordingly, during this sandwiching, the drum portion that is positioned between the upright surfaces 20*f* of the first convex portion 20*b* and the inner wall surfaces 21*d* of the second concave portion 21*b* that are positioned facing these upright surfaces 20*f* does not become pulled in a radial direction in an unrestrained state. As a result, due to the deformation behavior of the drum portion during the sandwiching, it is possible to restrict to a minimum the load acting on the ridgeline portions where the upright surfaces 20*f* and the outermost surface 20*g* intersect, and it is possible to limit abrasion of this ridgeline portion. In addition, it is possible to limit the occurrence of defects such as breakages of the convex portion 20*b*.

Furthermore, because the embossing processing is performed while the inner and outer circumferential surfaces of the drum portion located between the inner wall surfaces 21*d* that form the second concave portion 21*b* and the upright surfaces 20*f* of the first convex portion 20*b* that face these inner wall surfaces 21*d* are constrained by these upright surfaces 20*f* and the inner wall surfaces 21*d*, the embossing processed portion 52*a* can be formed in the shape of the respective wall surfaces of the first convex portion 20*b* and the second concave portion 21*b*.

Accordingly, by causing the upright surfaces 20*f* and the inner wall surfaces 21*d* to each extend sharply in the radial direction from the outer circumferential surfaces of the respective rotating bodies 20 and 21, it is possible to reliably form an embossing processed portion 52*a* that stands sharply upright in the radial direction from the circumferential surface of the drum portion. In particular, during the sandwiching, because the first convex portion 20*b* and the second concave portion 21*b* are both elastically deformed towards the inner side in the radial direction of the rotating bodies 20 and 21, the sharp shape of the first convex portion 20*b* and the second concave portion 21*b* can be reliably imparted to the drum portion of the can base 50.

Furthermore, as a result of it being possible to form this type of embossing processed portion 52*a*, the distance between adjacent embossing processed portions can be decreased, and it becomes possible to perform what is known as fine processing in which a plurality of embossing processed portions are formed in a tight group.

Moreover, in the present embodiment, because the first and second rotating bodies 20 and 21 are formed from the aforementioned urethane resin, and the embossing processed portion 52*a* is formed while the first convex portion 20*b* and the second concave portion 21*b* are undergoing the elastic deformation, when the sandwiching of the drum portion between the first and second rotating bodies 20 and 21 is cancelled, the elastic deformation of the first convex portion 20*b* and the second concave portion 21*b* is also cancelled, and the first convex portion 20*b* and the second concave portion 21*b* are moved restoratively towards the outer side in the radial direction of the respective rotating bodies 20 and 21.

Accordingly, even if the engagement between the embossing processed portion 52*a* and the first convex portion 20*b* and second concave portion 21*b* is not cancelled in spite of the sandwiching being cancelled, the inner circumferential surface of the drum portion is moved outwardly in the radial direction by the restorative movement of the first convex portion 20*b* and the second concave portion 21*b* while the outer circumferential surface thereof is moved inwardly in the radial direction so that when the sandwiching is cancelled, the engagement can also be cancelled.

Furthermore, because the first and second rotating bodies 20 and 21 are formed from the above described urethane resin, it becomes possible to restrict to a minimum the load that is acting on the inner and outer circumferential surfaces of the can base 50 during embossing processing, and it is possible to substantially prevent any scratching of the coating film that is formed on the inner and outer circumferential surfaces of the can base 50.

Moreover, because the first convex portion 20*b* is formed on the outer circumferential surface of the first rotating body 20, and because the second concave portion 21*b* is formed on the outer circumferential surface of the second rotating body 21, it becomes possible to form the convex embossing processed portion 52*a*, which protrudes outwardly in the radial direction on the outer circumferential surface of the can base 50, such that it rises up sharply from the outer circumferential surface of the can base 50. It is thus possible to form a can body 52 that has a particularly pleasing appearance and also has product identification capabilities.

In the can body 52 that is formed in the above described manner, because the embossing processed portion 52*a* protrudes outwardly in the radial direction from the outer circumferential surface of the drum portion and rises sharply upwards from this outer circumferential surface, it is possible to equip this can body 52 with an even more conspicuous product identification capability, and it is possible to suppress any rupturing of the coating film that is formed on the inner and outer surfaces of the can body 52.

In particular, because the embossing processed portion 52*a* is formed with the drum portion in a state of being elastically deformed inwardly in the radial direction, it is possible to limit plastically deformed portions to the embossing processed portion 52*a* on the drum portion, and it is possible to even more reliably prevent any reduction in the buckling strength of the can body 52 as well as any occurrence of the aforementioned blocking.

Furthermore, in the can body manufacturing apparatus 10, when the rotating bodies 20 and 21 are moved apart in the radial direction by the thickness of the drum portion of the can base 50 from a state in which the respective outer circumferential surfaces of the first and second rotating bodies 20 and 21 are in contact with each other, because the gap between the wall surfaces 20*f*, 20*f*, and 20*g* of the first convex portion 20*b* and the wall surfaces 21*d*, 21*d*, and 21*e* of the second concave portion 21*b* that face each other from among the wall surfaces respectively forming the first convex portion 20*b* and the second concave portion 21*b* that face each other is formed so as to be substantially equal to the thickness of the drum portion, during the sandwiching, it is possible to reliably achieve a state in which the wall surfaces forming the first convex portion 20*b* are in close contact with the wall surfaces forming the second concave portion 21*b* via the drum portion.

Furthermore, because the inner wall surfaces 21*d* and 21*d* of the second concave portion 21*b* are formed in a tapered shape in which the distance between the wall surfaces 21*d* and 21*d* that face each other becomes gradually smaller moving from the outer circumferential surface of the second convex portion 21*a* towards the inner side in the radial direction of the second rotating body 21, and because the upright surfaces 20*f* of the first convex portion 20*b* are formed in a tapered shape in which the distance between the wall surfaces 20*f* and 20*f* that face each other becomes gradually smaller moving from the outer circumferential surface of the first concave portion 20*a* towards the outer side in the radial direction of the first rotating body 20, when the drum portion of the can base 50 is sandwiched between the respective outer circumferential surfaces of the first and second rotating bodies 20 and 21, and the first convex portion 20*b* is fitted inside the second concave portion 21*b* via the drum portion, then it is possible to lighten the load from the respective wall surfaces that form the first convex portion 20*b* and the second concave portion 21*b* that acts on the inner and outer circumferential surfaces of the drum portion.

Accordingly, it is possible to largely prevent the coating film that is formed on the inner and outer circumferential surfaces of the can base 50 being scratched. In addition when the first and second rotating bodies 20 and 21 are moved away from each other after the embossing processing, it is possible to easily cancel the engagement between the embossing processed portion 52*a* that has been formed and the first convex portion 20*b* and second concave portion 21*b*.

Note that the technical range of the present invention is not limited to the above described embodiment and various modifications may be made thereto insofar as they do not depart from the spirit or scope of the present invention. For example, in the above described embodiment, a structure is shown in which the first and second rotating bodies 20 and 21 are formed using a urethane risen having a Shore D hardness of not less than 65 and not more than 85, however, they may also be made, for example, from metal and there are no particular restrictions on the material used.

Moreover, in the above described embodiment, when the drum portion is sandwiched between the outer circumferential surfaces of the first and second rotating bodies 20 and 21, the wall surfaces 20*f*, 20*f*, and 20*g* that form the first convex portion 20*b* are placed in close contact via the drum portion with the wall surfaces 21*d*, 21*d*, and 21*e* that form the second concave portion 21*b* while the first convex portion 20*b* and the second concave portion 21*b* are in a state of being elastically deformed towards the inner side in the radial direction of the respective rotating bodies 20 and 21, however, this elastic formation and close contact are not absolutely essential.

Furthermore, when the sandwiching of the drum portion by the first and second rotating bodies 20 and 21 is cancelled, the present invention can be applied not only when the drum portion that corresponds to the first concave portion 20*a* and the second convex portion 21*a* is not completely restored by the restorative force, but also when a portion of the amount of deformation of the rotating bodies 20 and 21 is plastic deformation. Moreover, the first convex portion 20*b* is not limited to being formed at the deepest portion of the mortar-shaped first concave portion 20*a*, and it may also be formed on a sloping tapered surface.

Moreover, the present invention can be applied not only when forming the embossing processed portion 52*a* that protrudes outwardly in the radial direction from the outer circumferential surface of the drum portion, but also when forming an embossing processed portion that is recessed inwardly in the radial direction from the outer circumferential surface.

Furthermore, it is also possible for the first convex portion 20*b* to be formed as a V-shaped convex portion that does not have the outermost surface 20*g*, and the second concave portion 21*b* may also be formed as a V-shaped concave portion that does not have the bottom surface 21*e*.

Furthermore, it is also possible to employ first and second rotating bodies 20 and 21 in which the first concave portion 20*a* is not formed in the first rotating body 20 and the second convex portion 21*a* is not formed in the second rotating body 21. Namely, it is possible for an embossing processed portion 52*a* to be formed not only in portions of the drum portion that are elastically deformed in the radial direction, but for an embossing processed portion 52*a* to be formed directly on a drum portion that is not elastically deformed.

Another embodiment of the can body manufacturing method, can body, and can body manufacturing apparatus of the present invention will now be described based on the drawings. Note that the same symbols are used for portions that are the same as in the above described embodiment and a description thereof is omitted. Only points of variance are described.

Figure 6:
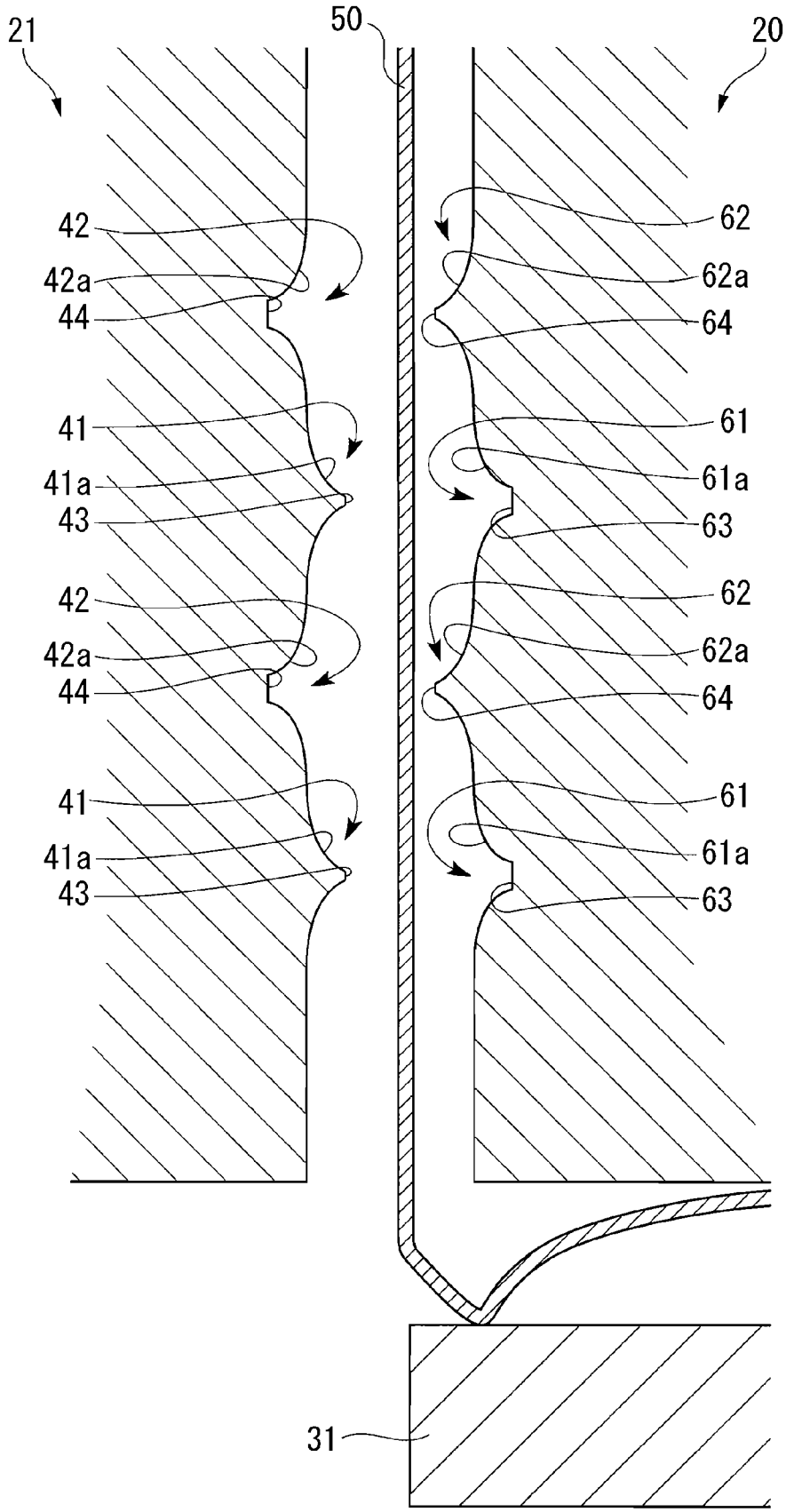
FIG. 6 is a first process drawing when the can body manufacturing method that is shown as another embodiment of the present invention is implemented, and is an enlarged cross-sectional view showing a portion of a first and second rotating body shown in FIG. 1.

As shown in FIG. 6, two groups that are each made up of a first concave portion 61 that is recessed towards the inside in the radial direction, and a second convex portion 62 that protrudes towards the outside in the radial direction and is placed adjacently to the first concave portion 61 in the axial direction of the first rotating body 20 are formed adjacent to each other in the axial direction on an outer circumferential surface of the first rotating body 20.

A first bent concave portion 63 that is recessed towards the inside in the radial direction via a first convex curved surface portion 61*a* is formed on a bottom surface of the first concave portion 61. The first convex curved surface portion 61*a* is formed as a convex curved surface in which the amount of recess gradually increases moving inwards in the radial direction of the first rotating body 20 towards the first bent concave portion 63, and in which the rate of change of this recess amount gradually increases. The amount of the recess in the first bent concave portion 63 is adjusted such that, when the drum portion of the can base 50 is inserted into this portion, the deformation that is generated in the drum portion exceeds the limit of elasticity.

Moreover, a second bent convex portion 64 that protrudes towards the outer side in the radial direction via a second concave curved surface portion 62*a* is formed at an outer end portion in the radial direction of the second convex portion 62. The second concave curved surface portion 62*a* is formed as a concave curved surface in which the amount of protrusion gradually increases moving outwards in the radial direction of the first rotating body 20 towards the second bent convex portion 64, and in which the rate of change of this protrusion amount gradually increases. In addition, the portion between the first bent concave portion 63 and the second bent convex portion 64 is formed so as to have an S-shaped vertical cross-section, so that the first concave portion 61 and the second convex portion 62 are smoothly connected.

Two groups that are each made up of a first convex portion 41 that protrudes towards the outer side in the radial direction at a position corresponding to the first concave portion 61, and a second concave portion 42 that is recessed towards the inner side in the radial direction at a position corresponding to the second convex portion 62 are formed adjacent to each other in the axial direction of the can on an outer circumferential surface of the second rotating body 21.

A first bent convex portion 43 that protrudes towards the outside in the radial direction via a first concave curved surface portion 41*a* is formed at a position corresponding to the first bent concave portion 63 at an outer end portion in the radial direction of the first convex portion 41. The first concave curved surface portion 41*a* is formed as a concave curved surface in which the amount of protrusion gradually increases moving outwards in the radial direction of the second rotating body 21 towards the first bent convex portion 43, and in which the rate of change of this protrusion amount gradually increases.

Moreover, a second bent concave portion 44 that is recessed towards the inner side in the radial direction via a second convex curved surface portion 42*a* is formed at a position corresponding to the second bent convex portion 64 on a bottom surface of the second concave portion 42. The second convex curved surface portion 42*a* is formed as a convex curved surface in which the amount of recess gradually increases moving inwards in the radial direction of the second rotating body 21 towards the second bent concave portion 44, and in which the rate of change of this recess amount gradually increases.

In addition, the portion between the first bent convex portion 43 and the second bent concave portion 44 is formed so as to have an S-shaped vertical cross-section, so that the first convex portion 41 and the second concave portion 62 are smoothly connected.

The first concave portion 61 and the first convex portion 41 are constructed such that, as a result of the first and second rotating bodies 20 and 21 moving towards or away from each other, the first convex portion 41 can be inserted in or withdrawn from the first concave portion 61. In the same way, the first concave portion 61 and the first convex portion 41 are constructed such that the first bent convex portion 43 is able to be inserted in or withdrawn from the first bent concave portion 63, the second convex portion 62 is able to be inserted in or withdrawn from the second concave portion 42, and the second bent convex portion 64 is able to be inserted in or withdrawn from the second bent concave portion 44.

Next, a method of forming a bent portion using the manufacturing apparatus 10 having the above described structure will be described.

Figure 7:
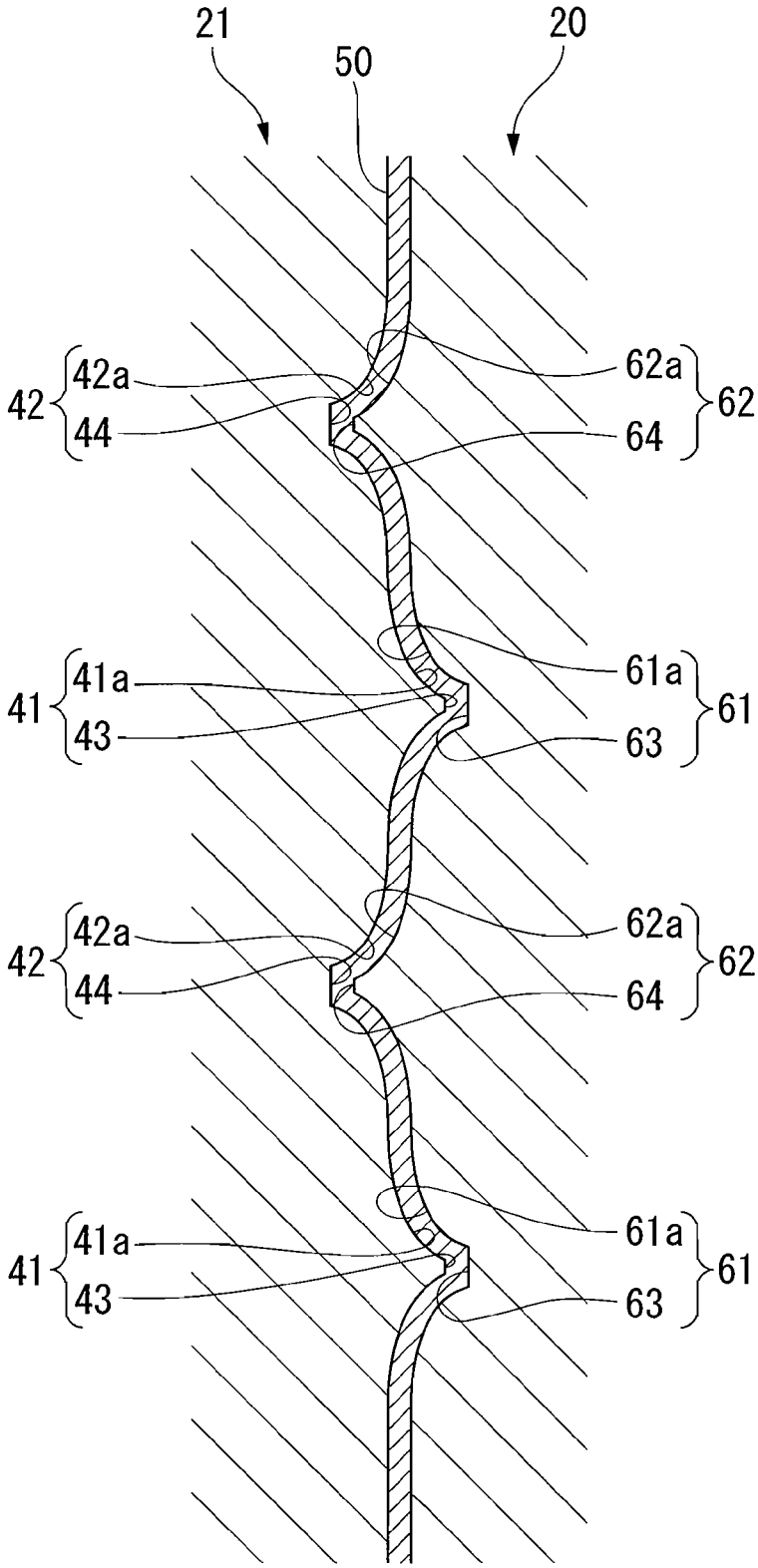
FIG. 7 is a second process drawing when the can body manufacturing method that is shown as another embodiment of the present invention is implemented, and is an enlarged cross-sectional view showing a portion of a first and second rotating body shown in FIG. 1.

As shown in FIG. 7, when the drum portion of the can base 50 is sandwiched between the first and second rotating bodies 20 and 21, the first bent convex portion 43 of the first convex portion 41 pushes the drum portion of the can base 50 from the outer side in the radial direction thereof towards the inner side in the radial direction (i.e., towards the inner side in the radial direction of the first rotating body 20). As a result, the inner circumferential surface side of the drum portion corresponding to this portion is forced into the first concave portion 61. At this time, the first bent convex portion 43 is inserted into the first bent concave portion 63 via the drum portion, and the first convex curved surface portion 61*a* is pressed against the first concave curved surface portion 41*a* via the drum portion. When this pressing occurs, the first convex curved surface portion 61*a* and the first concave curved surface portion 41*a* are each elastically deformed towards the inner side in the radial direction of the first and second rotating bodies 20 and 21.

Moreover, in the same way as is described above, as a result of the second bent convex portion 64 of the second convex portion 62 pushing the drum portion of the can base 50 from the inner side in the radial direction thereof towards the outer side in the radial direction (i.e., towards the inner side in the radial direction of the second rotating body 21), the outer circumferential surface side that corresponds to this portion is forced into the second concave portion 42. At this time, the second bent convex portion 64 is inserted into the second bent concave portion 44 via the drum portion, and the second convex curved surface portion 42*a* is pressed against the second concave curved surface portion 62*a* via the drum portion. When this pressing occurs, the second convex curved surface portion 42*a* and the second concave curved surface portion 62*a* are each elastically deformed towards the inner side in the radial direction of the first and second rotating bodies 20 and 21.

In the portion of the drum portion of the can base 50 that corresponds to the first bent convex portion 43 and the first bent concave portion 63, namely, in the bent portion, the deformation that is generated exceeds the limit of elasticity. Moreover, in the portion of the drum portion of the can base 50 that corresponds to the second bent convex portion 64 and the second bent concave portion 44, in the same manner as described above, the deformation that is generated exceeds the limits of elasticity. Accordingly, these bent portions are plastically deformed.

Because the shape of the drum portion tries to return to its pre-molding shape as a result of the elastic deformation component of the deformation that was applied to the drum portion being restored when the sandwiching is cancelled, the amount of restoration thereof is added as surplus to the portion of the drum portion of the can base 50 that corresponds to the first convex portion 41 and the first concave portion 51. Specifically, the portion of the drum portion of the can base 50 that corresponds to the first convex portion 41 and the first concave portion 61 is formed as a point in which the amount of deformation moving inwards in the radial direction of the second rotating body 21 gradually increases as it approaches the portion corresponding to the first bent convex portion 41 and the first bent concave portion 63, and in which the rate of change of this deformation amount increases.

Namely, the portion of the drum portion that corresponds to the first convex curved surface portion 61*a* and the first concave curved surface portion 41*a* is made to undergo greater elastic deformation than the shape that the can body 52 will have in its ultimate form with the result that the amount of deformation towards the outer side in the radial direction of the first rotating body 20 gradually increases as it approaches the portion which corresponds to the first bent convex portion 43 and the first bent concave portion 63. Note that the amount of deformation and rate of change can be set using the radius of curvature of the first convex curved surface portion 61*a* and the first concave curved surface portion 41*a*.

Moreover, in the same way, the portion of the drum portion of the can base 50, that corresponds to the second convex portion 62 and the second concave portion 42 is formed as a point in which the amount of deformation moving outwards in the radial direction of the second rotating body 21 gradually increases as it approaches the portion corresponding to the second bent convex portion 64 and the second bent concave portion 44, and in which the rate of change of this deformation amount increases.

Namely, the portion of the drum portion that corresponds to the second convex curved surface portion 42*a* and the second concave curved surface portion 62*a* is made to undergo greater elastic deformation than the shape that the can body 52 will have in its ultimate form with the result that the amount of deformation towards the outer side in the radial direction of the second rotating body 21 gradually increases as it approaches the portion which corresponds to the second bent convex portion 64 and the second bent concave portion 44. Note that the amount of deformation and rate of change can be set using the radius of curvature of the second convex curved surface portion 42*a* and the second concave curved surface portion 62*a*.

Figure 8:
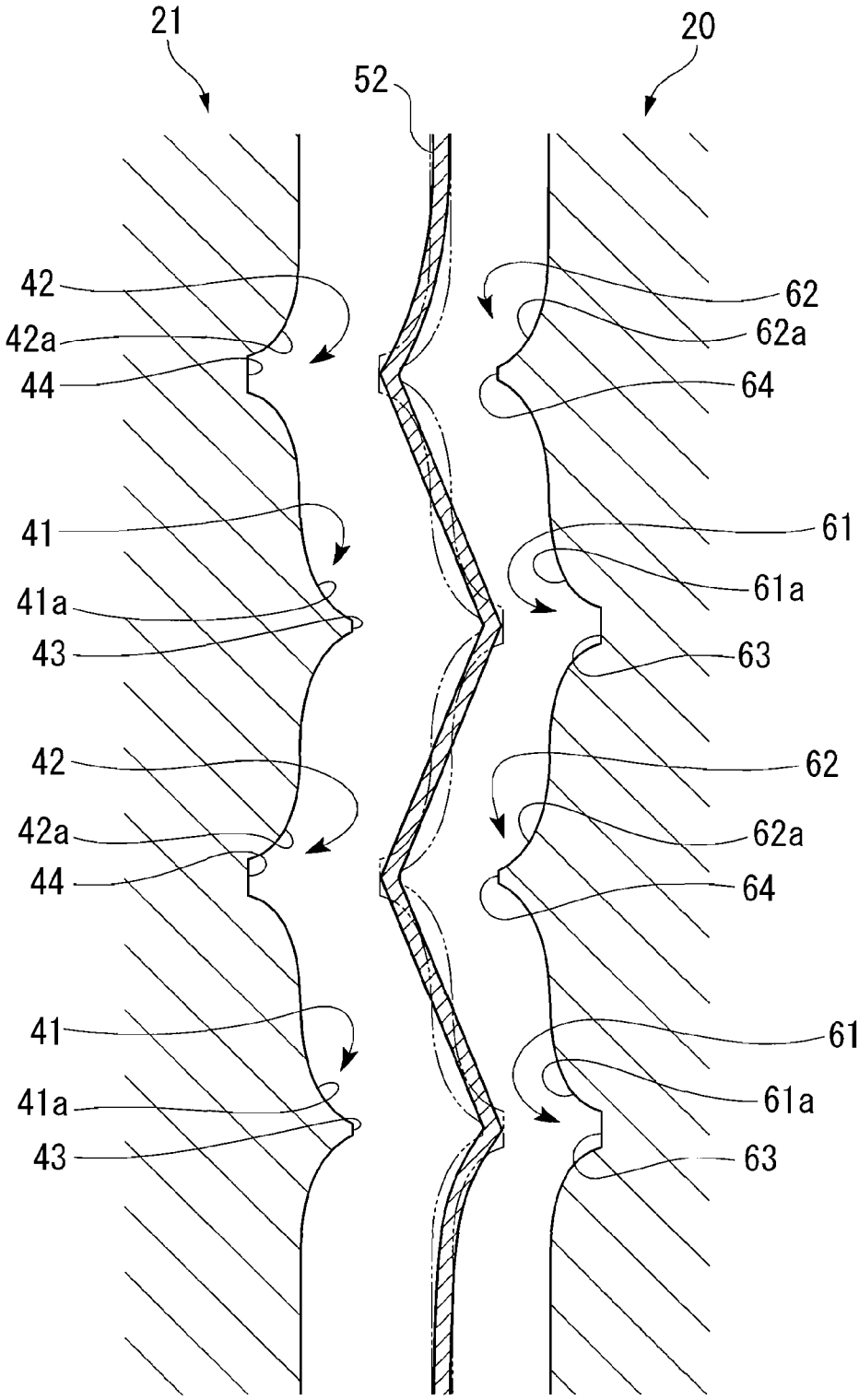
FIG. 8 is a third process drawing when the can body manufacturing method that is shown as another embodiment of the present invention is implemented, and is an enlarged cross-sectional view showing a portion of a first and second rotating body shown in FIG. 1.
Figure 9:
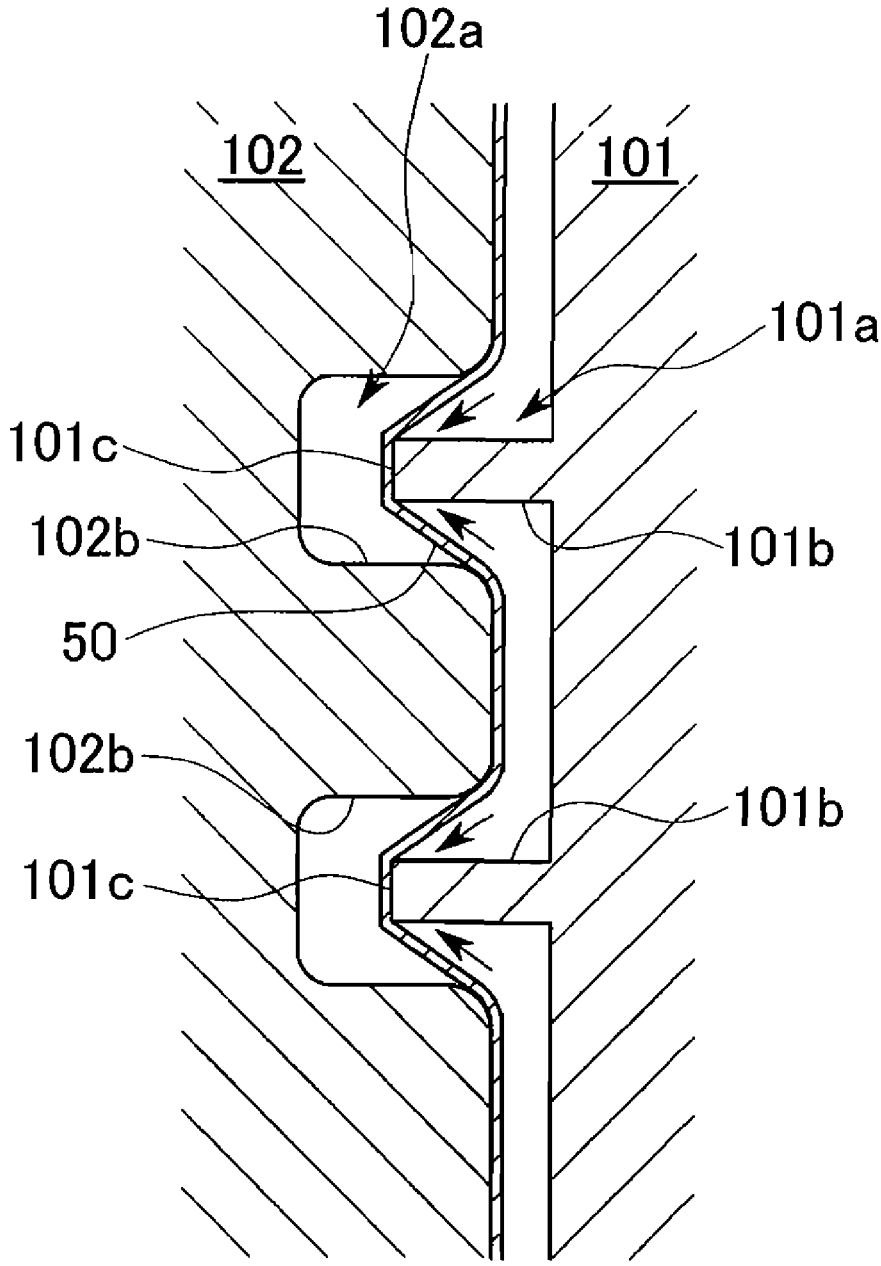
FIG. 9 PRIOR ART
FIG. 9 is an enlarged cross-sectional view showing a portion of a can body manufacturing apparatus when a can body manufacturing method is implemented in a conventional example according to the present invention.

In this state, if the sandwiching of the drum portion between the first and second rotating bodies 20 and 21 is cancelled, as shown in FIG. 8, those portions corresponding to the first bent convex portion 43 and the first bent concave portion 63 are positioned further to the inner side in the radial direction of the can base 50 than portions that are peripheral to these portions, namely, than those portions that are pushed by the first convex curved surface portions 61*a* against the first concave curved surface portions 41*a*. Moreover, those portions corresponding to the second bent convex portion 64 and the second bent concave portion 44 are positioned further to the outer side in the radial direction of the can base 50 than portions that are peripheral to these portions, namely, than those portions that are pushed by the second convex curved surface portions 42*a* against the second concave curved surface portions 62*a*.

Furthermore, the portions of the drum portion which are peripheral to the bent portions that are formed by being plastically deformed so as to protrude towards the inner side in the radial direction of the first rotating body 20 by the first bent convex portions 43 and the first bent concave portions 63 are moved restoratively when the sandwiching is cancelled by their elastic restorative force towards the inner side in the radial direction of the first rotating body 20. In contrast, the portions of the drum portion which are peripheral to the bent portions that are formed by being plastically deformed so as to protrude towards the inner side in the radial direction of the second rotating body 21 by the second bent convex portions 64 and the second bent concave portions 44 are moved restoratively when the sandwiching is cancelled by their elastic restorative force towards the inner side in the radial direction of the second rotating body 21.

As a result of the above, a can body 52 is formed as a result of both the bent portions that are formed by the first bent convex portions 43 and the first bent concave portions 63, and the bent portions that are formed by the second bent convex portions 64 and the second bent concave portions 44 forming a ridgeline that protrudes towards the inner side or the outer side in the radial direction of the drum portion, and the portion between these two bent portions forming a straight line when a vertical cross section thereof is viewed.

As has been described above, according to the method of manufacturing a can body according to the present embodiment, because portions of the drum portion that correspond to the first convex curved surface portions 61*a* and the first concave curved surface portions 41*a* are elastically deformed towards the outer side in the radial direction of the first rotating body 20 by a larger deformation amount than the shape that the can body 52 will ultimately take, and because the drum portion is inserted by the first bent convex portion 43 into the first bent concave portion 63, it is possible to provide a sufficient amount of distortion to plastically deform and bend the inserted portion of the drum portion.

Moreover, with consideration given to the fact that portions that are peripheral to the bent portions are moved restoratively by elastic deformation when the sandwiching is cancelled, the drum portion is pushed into the first concave curved surface portions 41*a* by the first convex curved surface portions 61*a* so that the portions that are peripheral to the bent portions are elastically deformed in advance by a greater amount than the shape that the can body 52 will ultimately take. As a result, it is possible to prevent sagging occurring in the bent portions even if the portions that are peripheral to the bent portions make the restorative movement.

As a result of the above, even if there is only a small amount of concavity and convexity in a bent portion, a can body 52 can still be obtained that makes it possible to excellently visualize the ridgeline of this bent portion.

Furthermore, when the sandwiching is cancelled, because the portion that is pressed by the first convex curved surface portion 61*a* into the first concave curved surface portion 41*a* is moved restoratively due to the elastic deformation, even if a bent portion is formed by the first convex portion 41 and the first concave portion 61 so as to protrude towards the inner side in the radial direction of the can base 50, it is still possible to easily pull the first rotating body 20 from inside the can body 52 without the first rotating body 20 becoming caught on the bent portion.

Moreover, in the present embodiment, not only is a bent portion formed by the first convex portion 41 and the first concave portion 61, but a bent portion is also formed by the second convex portion 62 and the second concave portion 42. As a result, two types of bent portions that each have a different direction of protrusion in the radial direction are formed on the drum portion of the can body 52, and the respective bent portions can be visually highlighted so that the respective ridgelines of each can be even more excellently visualized.

Furthermore, because the first and second rotating bodies 20 and 21 are formed from a urethane material having a Shore D hardness of not less than 65 and not more than 85, it is possible to prevent the coating film that is formed on the inner and outer circumferential surfaces of the drum portion being damaged when the drum portion is sandwiched.

Moreover, when the drum portion is being sandwiched between the outer circumferential surfaces of the first and second rotating bodies 20 and 21, in a state in which the first convex curved surface portion 61*a* and the first concave curved surface portion 41*a* are each elastically deformed towards the inner side in the radial direction of the first and second rotating bodies 20 and 21, because the first convex curved surface portion 61*a* is pushed via the drum portion into the first concave curved surface portion 41*a*, it is possible to form a bent portion that can be even more clearly visualized. In addition, when the sandwiching is cancelled, because the first convex curved surface portion 61*a* and the first concave curved surface portion 41*a* are each moved restoratively towards the circumferential surface of the can body 52, it is possible to reliably restrict the formed bent portion becoming caught on the first convex portion 41 or the first concave portion 61. In the same way as is described above, because the second convex curved surface portion 42*a* and the second concave curved surface portion 62*a* are also pushed in an elastically deformed state, it is possible to reliably restrict the formed bent portion becoming caught on the second convex portion 62 or the second concave portion 42.

Note that the present invention is not limited to the above described embodiments, and various modifications may be made insofar as they do not depart from the spurt or scope of the present invention.

For example, in the above described embodiment, bent portions are formed extending in a circumferential direction, however, it is also possible to form bent portions that extend in the can axial direction of the can body 52.

Moreover, two groups that are each made up of the first concave portion 61 and the second convex portions 62 are formed on the outer circumferential surface of the first rotating body 20, however, it is also possible to employ a structure in which one group of each are formed, or to employ a structure in which three groups or more of each are formed. At this time, the first convex portion 41 and the second concave portion 42 are formed on the outer circumferential surface of the first rotating body 20 so as to correspond to the first concave portion 61 and the second convex portion 62 that are formed on the outer circumferential surface of the first rotating body 20.

It is also possible to employ a structure in which only one of the first concave portion 61 and the second convex portion 62 are formed on the outer circumferential surface of the first rotating body 20. At this time, only one of the first convex portion 41 and the second concave portion 42 is formed on the outer circumferential surface of the first rotating body 20 so as to correspond to the one of the first concave portion 61 and the second convex portion 62 that is formed on the outer circumferential surface of the first rotating body 20.

Moreover, on the first rotating body 20, the first concave portions 61 and the second convex portions 62 are formed so as to create vertically S-shaped cross-sections between the first bent concave portions 63 and the second bent convex portions 64, however, they may also be formed so as to protrude gradually from the first bent concave portion 63 outwardly in the radial direction towards the second bent convex portion 64, or, alternatively, they may be formed in some other configuration. At this time, the first rotating body 20 is also formed so as to correspond to the first rotating body 20.

In addition, the first rotating body 20 is placed inside the can base 50, however, it is also possible to employ a structure in which the first rotating body 20 is placed inside the can base 50.

Furthermore, in the present embodiment, when the drum portion is being sandwiched between the outer circumferential surfaces of the first and second rotating bodies 20 and 21, in a state in which the first convex curved surface portion 61*a* and the first concave curved surface portion 41*a* are each elastically deformed towards the inner side in the radial direction of the first and second rotating bodies 20 and 21, the first convex curved surface portion 61*a* is pushed via the drum portion into the first concave curved surface portion 41*a*. In addition, in the same way as is described above, the second convex curved surface portion 42*a* and the second concave curved surface portion 62*a* are also pushed in an elastically deformed state, however, instead of this, it is possible to employ a structure in which they are not elastically deformed in this manner.

INDUSTRIAL APPLICABILITY

There are provided a can body manufacturing method, a can body, and a can body manufacturing apparatus that make it possible to reliably create convex embossing processing that protrudes towards the outer side in the radial direction from the outer circumferential surface of the drum portion of a can base. Moreover, there are provided a can body manufacturing method, a can body, and a can body manufacturing apparatus that make it possible to form distinct embossing processed portions that rise up sharply in the radial direction from the circumferential surface of the drum portion of a can base, and to also form a plurality of embossing processed portions in a tight grouping on a limited area. Furthermore, there are provided a can body manufacturing method, a can body, and a can body manufacturing apparatus that make it possible to excellently visualize a ridge line in a bent portion.

The invention claimed is:

1. A can body manufacturing method which is performed using a can body manufacturing apparatus having a first rotating body and a second rotating body that are supported rotatable around rotation axes that are parallel with each other, and in which a can body is formed by creating embossing processed portions on a drum portion of the can body by placing the first rotating body inside a cylindrical can base having one closed end, and placing the second rotating body outside the can base, and then moving the first and second rotating bodies towards each other and, in a state in which the drum portion of the can base is sandwiched between respective outer circumferential surfaces of these rotating bodies, rotating the first and second rotating bodies around their rotation axes, the method comprising the steps of;

providing the first rotating body with a first concave portion formed on an outer circumferential surface of the first rotating body so as to be recessed in an inwardly-radial direction of the first rotating body, and a first convex portion formed in the first concave portion so as to protrude in an outwardly-radial direction of the first rotating body;

providing the second rotating body with a second convex portion formed at a portion corresponding to the first concave portion on an outer circumferential surface of the second rotating body so as to protrude in an outwardly-radial direction of the second rotating body, and a second concave portion that formed in a portion of the second convex portion corresponding to the first convex portion so as to be recessed in an inwardly-radial direction of the second rotating body;

pushing the drum portion by the second convex portion from the outer circumferential surface side of the drum portion in an inwardly-radial direction thereof such that at least some of the total amount of deformation in the inwardly-radial direction becomes elastic deformation when the drum portion is sandwiched between the outer circumferential surfaces of the first and second rotating bodies;

fitting the first convex portion to the second concave portion via the drum portion in a state where the inner circumferential surface side corresponding to the elastically deformed portion has been pushed into the first concave portion;

thereafter, the drum portion corresponding to the first concave portion and the: second convex portion is moved restoratively in an outwardly-radial direction of the drum portion by the elastic restorative force of the drum portion when the sandwiching between the outer circumferential surfaces of the first and second rotating bodies is stopped; and positioning the outer circumferential surface of that portion of the drum portion corresponding to the first convex portion and the second concave portion further towards the outer side in the radial direction of the drum portion than the outer circumferential surface of the drum portion excluding those portions corresponding to the first convex portion and the second concave portion.

2. A can body manufacturing method which is performed using a can body manufacturing apparatus having a first rotating body supported rotatably around a rotation axis, and which has at least one concave portion formed on an outer circumferential surface of the first rotating body so as to be recessed in an inwardly-radial direction of the first rotating body and a convex portion formed on the outer circumferential surface of the first rotating body so as to protrude in an outwardly-radial direction of the first rotating body and a second rotating body supported rotatably around a rotation axis that is-parallel with the rotation axis of the first rotating body and which has at least one of a concave portion formed on an outer circumferential surface of the second rotating body so as to be recessed in an inwardly-radial direction of the second rotating body and a convex portion formed on the outer circumferential surface of the second rotating body so as to protrude in an outwardly-radial direction of the second rotating body, and in which a can body is formed by creating embossing processed portions on a drum portion of the can body by placing the first rotating body inside a cylindrical can base having one closed end, and placing the second rotating body outside the can base, and then moving the first and second rotating bodies towards each other, and then sandwiching the drum portion of the can base between the respective outer circumferential surfaces of these rotating bodies such that the convex portion is inside the concave portion via the drum portion, and, in this state, by then rotating the first and second rotating bodies around their rotation axes, comprising the steps of:

forming the first and second rotating bodies which are made from urethane resin having a Shore D hardness of not less than 65 and not more than 85; and closely contacting wall surfaces forming convex portions with wall surfaces forming concave portions via the drum portion when the drum portion is sandwiched between the outer circumferential surfaces of the first and second rotating bodies, respectively, in a state where at least the convex portions and the concave portions are elastically deformed towards the inner side in the inwardly-radial direction of the respective rotating bodies.

3. The can body manufacturing method according to claim 2, wherein the convex portion is formed on the outer circumferential surface of the first rotating body, and the concave portion is formed on the outer circumferential surface of the second rotating body.

4. The can body manufacturing method according to claim 2, wherein a first concave portion being recessed in the inwardly-radial direction of the first rotating body is formed on the outer circumferential surface of the first rotating body, and a first convex portion protruding in the outwardly-radial direction of the first rotating body is formed in the first concave portion, a second convex portion protruding in the outwardly-radial direction of the second rotating body is formed on the outer circumferential surface of the second rotating body in a portion corresponding to the first concave portion, and a second concave portion being recessed in the inwardly-radial direction of the second rotating body is formed in a portion of the second convex portion corresponding to the first convex portion, when the drum portion is sandwiched between the outer circumferential surfaces of the first and second rotating bodies, the drum portion is pushed by the second convex portion from the outer circumferential surface side of the drum portion in an inwardly-radial direction thereof such that at least some of the total amount of deformation in the inwardly-radial direction becomes elastic deformation, in a state in which an inner circumferential surface side corresponding to the elastically deformed portion has been pushed into the first concave portion, the first convex portion is fitted inside the second concave portion via the drum portion, thereafter, when the sandwiching between the outer circumferential surfaces of the first and second rotating bodies is cancelled, the outer circumferential surface of that portion of the drum portion corresponding to the first concave portion and the second convex portion is moved restoratively in an outwardly-radial direction of the drum portion by the elastic restorative force of the drum portion, and the outer circumferential surface of that portion of the drum portion corresponding to the first convex portion and the second concave portion is positioned further towards the outer side in the radial direction of the drum portion than the outer circumferential surface of the drum portion excluding those portions corresponding to the first convex portion and the second concave portion.

* * * * *